US008720959B2

(12) United States Patent
Wittke et al.

(10) Patent No.: US 8,720,959 B2
(45) Date of Patent: May 13, 2014

(54) DOOR OPENING MECHANISM WITH AUTOMATIC ADJUSTMENT OF THE DOOR OPENING LATCH

(75) Inventors: Norman Wittke, Albstadt (DE); Oliver Hirschoff, Messstetten (DE)

(73) Assignee: Assa Abloy Sicherheitstechnik GmbH (DE)

( * ) Notice: Subject to any disclaimer, the term of this patent is extended or adjusted under 35 U.S.C. 154(b) by 369 days.

(21) Appl. No.: 13/056,784

(22) PCT Filed: Aug. 1, 2009

(86) PCT No.: PCT/EP2009/005594

§ 371 (c)(1),
(2), (4) Date: Mar. 16, 2011

(87) PCT Pub. No.: WO2010/012496

PCT Pub. Date: Feb. 4, 2010

(65) Prior Publication Data

US 2011/0187130 A1 Aug. 4, 2011

(30) Foreign Application Priority Data

Aug. 1, 2008 (DE) ..... 10 2008 035 928

(51) Int. Cl.
*E05B 15/02* (2006.01)
*E05C 3/06* (2006.01)

(52) U.S. Cl.
USPC ..... 292/341.15; 292/201; 292/341.16

(58) Field of Classification Search
USPC ..... 292/201, 341.15, 341.16
See application file for complete search history.

(56) References Cited

U.S. PATENT DOCUMENTS

| | | | | |
|---|---|---|---|---|
| 352,154 | A * | 11/1886 | Rousseau | 292/341.16 |
| 419,766 | A * | 1/1890 | Glaeser | 292/341.16 |
| 518,119 | A * | 4/1894 | Schnepf | 292/341.16 |
| 1,274,381 | A * | 8/1918 | Brooks | 292/341.16 |

(Continued)

FOREIGN PATENT DOCUMENTS

| | | | |
|---|---|---|---|
| DE | 4229239 | C1 | 9/1993 |
| DE | 19814229 | A1 | 10/1999 |

(Continued)

OTHER PUBLICATIONS

International Search Report, PCT/EP2009/005594, dated Dec. 30, 2009.

*Primary Examiner* — Carlos Lugo
(74) *Attorney, Agent, or Firm* — Lerner, David, Littenberg, Krumholz & Mentlik, LLP

(57) ABSTRACT

The invention describes a remote-actuable door opener for installation in a door having a preferably positionally fixed door frame and having a door leaf movably mounted thereon. The door leaf has a movable door opener catch (1) and a remote-actuable blocking device (2) which interacts directly or indirectly with the door opener catch (1) in such a way that the door opener catch (1) can be switched into a blocking position and into a release position. It is essential that an actuating device (200) is provided which automatically sets the door opener catch (1) into a position in which the door opener catch (1) abuts against the lock catch (90) in the closed position of the door. Here, the door opener catch (1) is in particular formed from a bearing body (110) and from a catch body (10) which is displaceably guided on the bearing body and which is driven by the actuating device (200) in the direction of the actuating movement.

34 Claims, 12 Drawing Sheets

(56) References Cited

U.S. PATENT DOCUMENTS

| | | | | | |
|---|---|---|---|---|---|
| 1,618,738 | A | * | 2/1927 | Weiss | 292/341.16 |
| 1,638,240 | A | * | 8/1927 | Caron | 292/341.16 |
| 1,854,768 | A | * | 4/1932 | Schneider | 292/341.16 |
| 2,066,278 | A | * | 12/1936 | Keil | 292/341.16 |
| 3,122,388 | A | * | 2/1964 | Powers | 292/341.16 |
| 3,521,921 | A | * | 7/1970 | Miyazaki | 292/201 |
| 3,543,547 | A | * | 12/1970 | Sugiyama | 70/277 |
| 3,774,422 | A | * | 11/1973 | Hogan et al. | 70/264 |
| RE30,263 | E | * | 4/1980 | Horvath | 292/341.16 |
| 4,595,220 | A | * | 6/1986 | Hanchett et al. | 292/341.17 |
| 5,042,857 | A | * | 8/1991 | Burrows et al. | 292/341.16 |
| 5,195,792 | A | * | 3/1993 | Stendal | 292/341.16 |
| 5,439,262 | A | | 8/1995 | Fuss et al. | |
| 5,810,055 | A | * | 9/1998 | Haeussler et al. | 139/57 |
| 5,997,054 | A | * | 12/1999 | Baudu et al. | 292/201 |
| 6,459,223 | B2 | * | 10/2002 | Mauel et al. | 318/445 |
| 6,926,318 | B2 | * | 8/2005 | Oxley | 292/341.16 |
| 6,935,663 | B2 | * | 8/2005 | Schildwachter et al. | 292/341.16 |
| 6,966,585 | B2 | * | 11/2005 | Egi et al. | 292/341 |
| 2009/0235767 | A1 | * | 9/2009 | Garneau et al. | 74/56 |

FOREIGN PATENT DOCUMENTS

| | | | |
|---|---|---|---|
| DE | 202004007910 | U1 | 7/2004 |
| DE | 102004037827 | A1 | 2/2006 |
| DE | 102006001560 | A1 | 7/2007 |
| EP | 0841474 | A1 | 5/1998 |

* cited by examiner

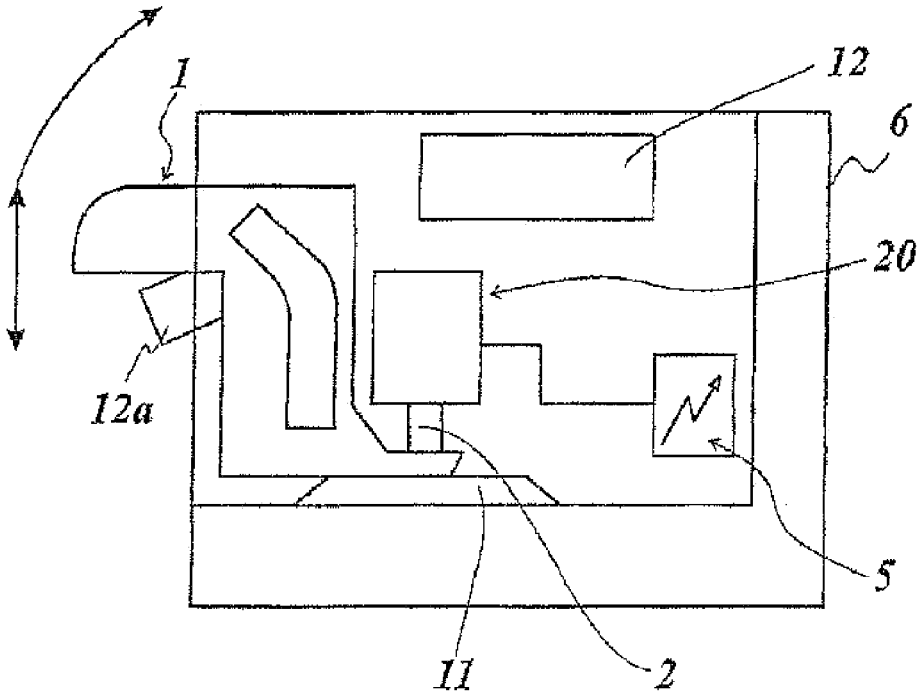
Fig. 7.1
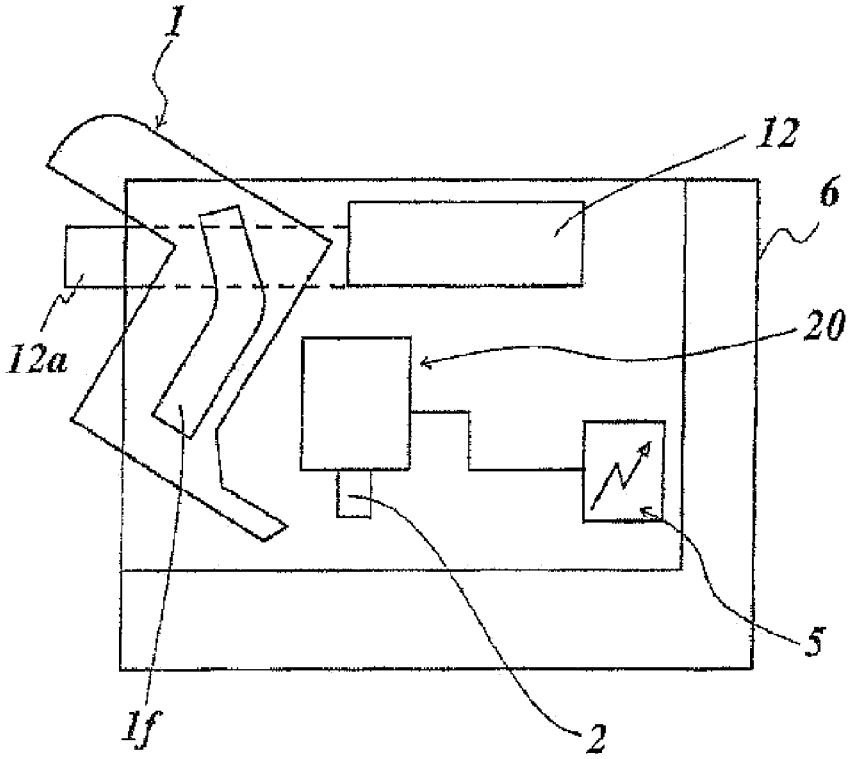
Fig. 7.2

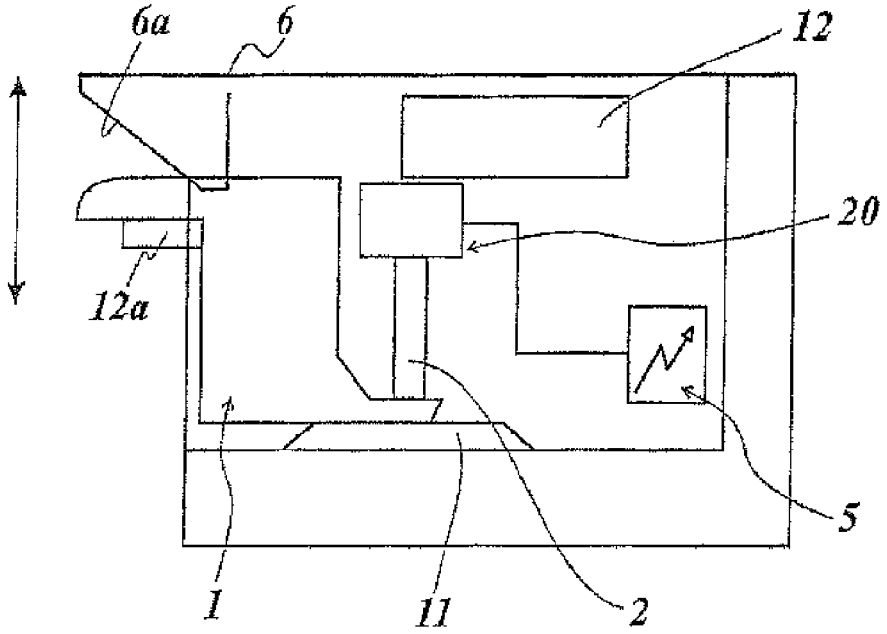
Fig. 8.1
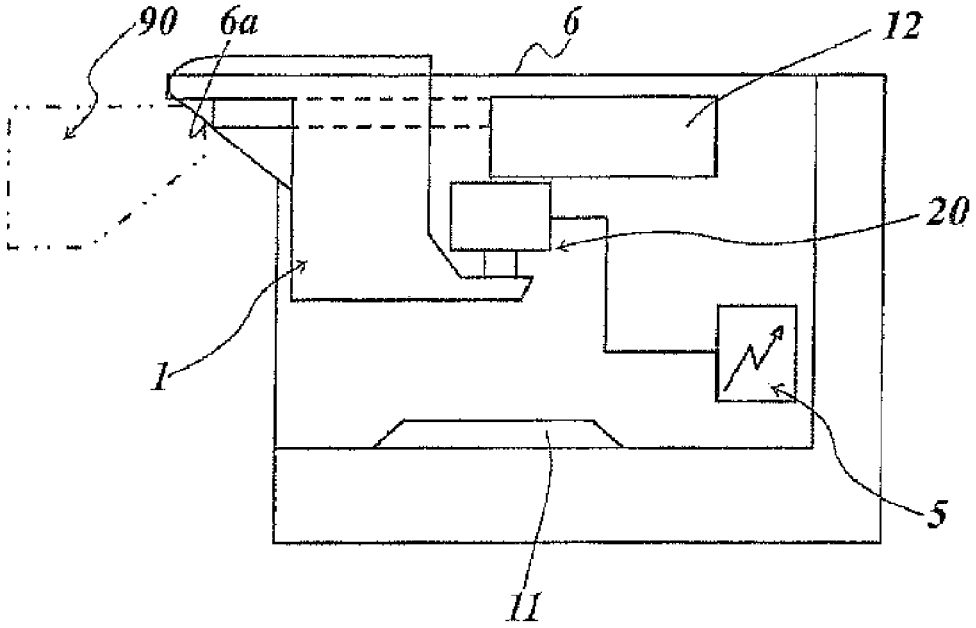
Fig. 8.2

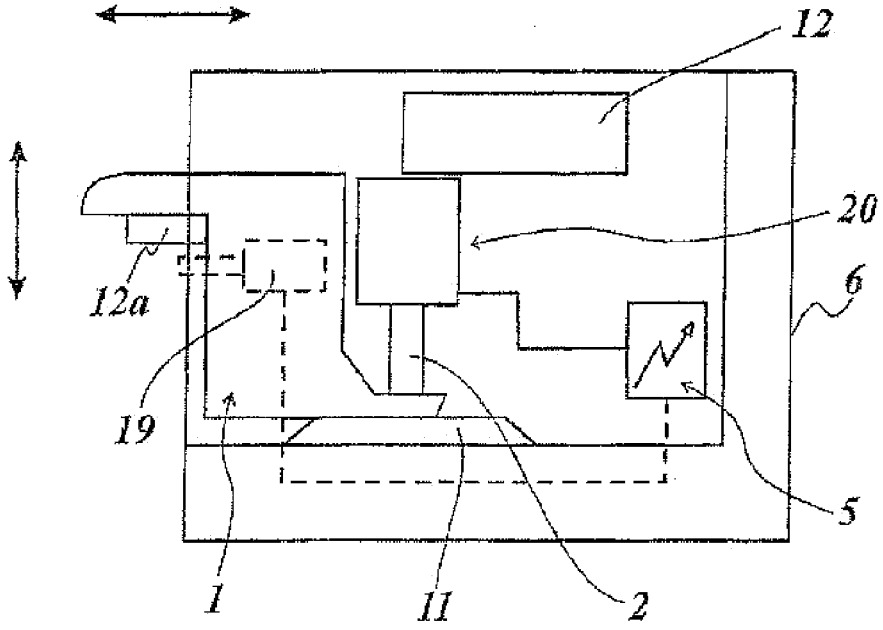
Fig. 9.1
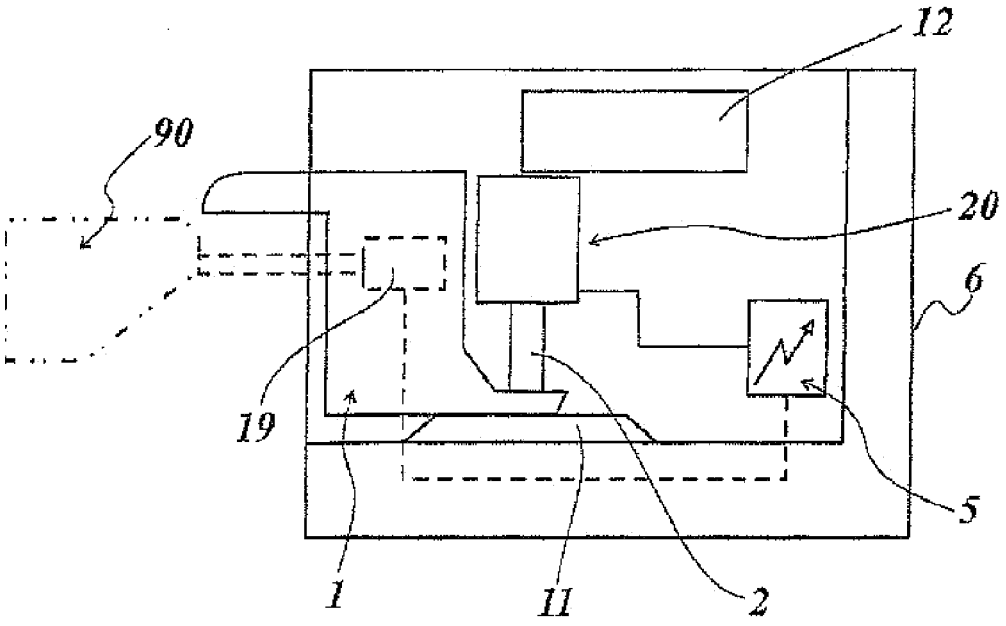
Fig. 9.2

DOOR OPENING MECHANISM WITH AUTOMATIC ADJUSTMENT OF THE DOOR OPENING LATCH

CROSS REFERENCE TO RELATED APPLICATIONS

The present application is a national phase entry under 35 U.S.C. §371 of International Application No. PCT/EP2009/005594, filed Aug. 1, 2009, published in German, which claims the benefit of German Patent Application No. 10 2008 035 928.9, filed Aug. 1, 2008. The disclosures of said applications are incorporated by reference herein.

The invention proceeds from a remote-actuable door opener for installation in a door, preferably in the positionally fixed frame of a door, having a movable door opener catch and having a remote-actuable blocking device which interacts directly or indirectly with the door opener catch in such a way that the door opener catch can be switched into a blocking position and into a release position.

Some expressions will firstly be defined below:

The expression "remote-actuable door opener" is to be understood in the present application to mean a "remote-actuable arresting device for a door". The arresting device has a remote-actuable blocking device and a door opener catch. The drive-output-side blocking element of the blocking device interacts indirectly or directly with the door opener catch and switches the door opener catch into a blocking position and into a release position. The blocking position means that the door opener catch is blocked and the door therefore cannot be opened. The release position means that said door opener catch is released, and the door can be opened.

A door opener is to be understood to mean not only the opener of a door but rather also the opener of a gate, of a window and/or of some other closure device with a movably mounted leaf. That is to say, in the present application, the expression "door" is also to be understood to mean a gate, a window and/or some other closure device with a movably mounted leaf. The expression "door opener" however does not mean that a unit for driving the opening movement of the door must be provided; such a unit may however be provided as an auxiliary device.

In the present application, the expression "leaf" or "door leaf" is to be understood to mean a rotary leaf and/or a sliding leaf composed or one or more such leaves. It may also refer to a similar closure device, which does not provide access, in the field of construction or furniture, for example also a smoke protection flap.

The expression "lock catch" is to be understood in the present application to mean the catch which interacts with the door opener catch. Said lock catch may be rigidly mounted or resiliently mounted. Said lock catch need not—but may—be arranged in connection with a lock.

As regards the prior art:

DE 42 29 239 C1 is cited merely by way of example. Said document describes a door opener of the type mentioned in the introduction. In said door opener, the blocking device is designed as an electromechanical device composed of a lever device and an electromagnet. In said known door opener, the lever device, which is composed of a one-armed lever and a two-armed lever, engages directly on the door opener catch which is designed as a pivoting catch. The lever device is arrested by means of the electromagnet when the latter is electrically energized, such that the door opener catch is in its blocking position when the electromagnet is electrically energized, and said door opener catch is released when the electromagnet is electrically de-energized. Said known door opener therefore functions according to the so-called closed circuit principle; in contrast to the likewise known open circuit principle, in which the release position is assumed when the electromagnet is electrically energized and the blocking position is assumed when the electromagnet is electrically de-energized.

The door opener known from DE 42 29 239 C1, which thus operates according to the closed circuit principle, is a so-called escape door opener, that is to say it is designed for use in escape doors. For this use, it is necessary for the release position for opening the door to be assumed when the electrical current is switched off. To reliably ensure a release of the door opener catch even in the event of several people pushing against the door, which is essential for the use as an escape door opener, it is provided in said known door opener that the lever device is composed of a two-armed securing lever and a one-armed blocking lever. The securing lever interacts, by means of one of its arms as an armature plate, with the electromagnet, and said securing lever has on its other arm a specially designed stop for the blocking lever. Said stop arrangement is configured such that the blocking lever exerts a wedge-like displacement action on the stop and therefore, when the electrical current is switched off, the blacking lever reliably passes out of its stop position even if pressure is exerted on the door.

DE 10 2004 037 827 A1 discloses an electric door opener in which the door opener catch, which is designed as a pivoting catch, is adjustable in a stepped manner. In said document, said stepped adjustment is realized in that the door opener catch is composed of a basic body and a blocking body which has the catch blocking edge. The basic body and the blocking body are coupled to one another by means of a complementary intermeshing detent toothing, and can be fixed to one another by means of a screw connection. By means of said toothing, the adjustment can take place in a stepped manner according to the tooth spacing. The adjustable blocking body is in practice referred to as a screw-on piece. The adjustment must be carried out manually.

EP 0 841 474 A1 discloses a door opener whose door opener catch can be adjusted in a continuously variable manner by virtue of the door opener catch being composed of a basic body and of a blocking piston which can be adjusted in a continuously variable manner thereon by means of an eccentric device. Here, too, the adjustment must be carried out manually.

The invention is based on the object of further developing a door opener of the type mentioned in the introduction in such a way that it is of simple design and provides functional advantages in relation to conventional door openers.

Said object is achieved by means of the subject matter of patent claim 1. Said subject matter concerns a remote-actuable door opener for installation in a door having a positionally fixed door frame and having a door leaf movably mounted thereon. The door opener has a movable door opener catch and a remote-actuable blocking device, with the blocking device interacting directly or indirectly with the door opener catch in such a way that the door opener catch can be switched into a blocking position and into a release position.

An essential aspect of the solution is that an actuating device is provided which automatically sets the door opener catch into a position in which the door opener catch abuts against the lock catch in the closed position of the door. The door opener can be mounted on the positionally fixed door frame or the door leaf. The lock catch which interacts with the door opener catch is a lock catch of the door leaf or of the door frame depending on whether the door opener is mounted on the frame or on the door leaf.

With the actuating device provided according to the invention, an automatic adjustment of the door opener catch is obtained into the position in which the door opener catch abuts against the lock catch in the closed position of the door, that is to say, according to the invention, an automatic adjusting device of the door opener catch is provided, which adjusting device automatically sets the door opener catch into said position. The door opener catch is therefore self-adjusting. It is possible for a manual adjustment for aligning the screw-on piece, such as is required in the prior art in order to obtain an adjustment to the structural conditions during assembly or, in the event of servicing, to obtain an adaptation to changes arising as a result of use or weathering, to be dispensed with, or said adjustment may if appropriate be carried out manually merely as a rough pre-alignment during assembly. The fine alignment then takes place automatically during the operation of the door opener by means of the automatic self-adjustment, specifically preferably anew during or after every closure of the door and/or during or after every opening of the door. By means of the adjusting movement, a relative movement between the lock catch and the door opener catch is generated, specifically until the door opener catch abuts against the lock catch in a firm, preferably rattle-free manner in the closed position of the door.

The solution according to the invention also concerns a method for operating a door opener, in which method it is provided that during the operation of the door opener, the door opener catch is automatically set into a position in which the door opener catch abuts against the lock catch in the closed position of the door. It may be provided here that the automatic positioning of the door opener catch takes place during the closing of the door and/or after the closing of the door and/or in the closed position of the door. Significant advantages are obtained with the method according to the invention if it is provided that the automatic positioning of the door opener catch takes place during or after every opening and/or closing actuation of the door.

According to the invention, the actuating device forms the drive for the automatic self-adjustment of the door opener catch.

In preferred embodiments, the actuating device of the door opener catch may be designed as a force store device which can be coercively loaded during the opening of the door and/or during the closing of the door, and/or as a motor device which can be operated using external energy. In the case of the motor device which can be operated using external energy, it is possible for an electric motor unit, designed for example as an electromechanical motor or electrohydraulic motor or electrohydraulic pump, to be provided as a motor unit. In the case of the force store device which can be coercively loaded, it may be provided that said force store device is designed as a preferably mechanical spring store. The force store may however also be designed as some other force store, for example pneumatic store. It is essential that said force store is charged during the opening and/or closing of the door and then provides the energy for the actuating movement of the door opener catch.

In embodiments of the invention, the actuating device of the door opener catch may at the same time be formed as a restoring device of a drive-output-side blocking element of the blocking device. The restoring device may be designed identically or correspondingly to the restoring device of the blocking element of a conventional door opener, for example as a force store, preferably a mechanical spring device. Said force store may be stressed during the opening of the door by means of the action of the lock catch on the door opener catch, and then provide the energy for the restoring of the blocking element. In the present case, the blocking element can act on the door opener catch for the actuating movement.

In preferred embodiments, it is provided that the door opener catch is designed and/or mounted such that it can move through a maximum actuating travel of X mm, with X being a value from 2 to 15, preferably a value from 5 to 10.

High functional reliability is obtained in embodiments which provide that the actuating device of the door opener catch is designed so as to load the door opener catch in the direction of the actuating movement, specifically only in the region of the closed position of the door or only in a region which extends from an open position of the door with a door opening gap of Y mm to the closed position of the door, with Y being less than or equal to 15, preferably less than or equal to 10, particularly preferably less than or equal to 5.

Embodiments are particularly preferable in which it is provided that the blocking device of the door opener has, at the drive output side, a blocking element which can be automatically made to follow up the door opener catch in the closing direction by means of a follow-up device and which can additionally preferably be fixed in the followed-up position by means of the blocking device.

In particularly preferred embodiments, it is provided that the actuating device of the door opener catch and the follow-up device of the blocking element are formed as a common device. This may be realized for example by virtue of the actuating device having a self-locking motor unit.

Advantageous functionality with regard to the self-adjustment of the door opener catch and/or with regard to the follow-up of the blocking element is obtained in preferred embodiments which provide that the actuating device of the door opener catch and/or the follow-up device of the blocking element have/has a control device in order to vary the actuating speed and/or the actuating force during the actuating movement. Here, it may be advantageous for the control device to be connected to a memory device which registers the position of the door opener catch and/or the position of the blocking element. Particularly effective control of the movement of the door opener catch or of the blocking element is obtained in this way.

Particularly advantageous implementations are realized with embodiments in which the blocking device has a hydraulic circuit with a remote-controllable valve. To drive the hydraulic circuit or to generate the hydraulic pressure, an electrohydraulic pump may be provided as a motor unit. Alternatively or in addition, however, a hydraulic restoring device may also be provided, for example a piston-cylinder system in which the piston is supported on a force store, for example a restoring spring. In this connection, preferred refinements provide that the blocking element of the blocking device is designed as a drive output element of the actuating device of the door opener catch. In the embodiments with hydraulic circuit systems, a working piston may be provided which forms the blocking element of the blocking device and at the same time the drive output element or the actuating device.

The automatic self-adjustment of the door opener catch can therefore be realized in a particularly advantageous manner in embodiments in which the blocking device has a hydraulic circuit in which a valve and a working piston are arranged. The working piston, operating as a blocking element of the blocking device, can interact indirectly or directly with the door opener catch. The valve is designed as a remote-actuable valve which is connected such that, in the closed position of the valve, the door opener catch is in the blocking position, and when the valve is in the open position, the door opener catch is in the release position. Also provided is a restoring device which has a force store and which loads the working piston and/or the door opening catch in the direction for setting the blocking position. The force store may be designed as a mechanical restoring spring or else as some other store, for example pneumatic store. Instead of or in addition to the restoring spring device, a motor unit which can be operated using external energy may also be provided, which motor unit acts on the working piston and/or the door opener catch in the direction for setting the blocking position.

In said embodiments with a hydraulic blocking device, it is thus provided that the blocking device can be switched by means of a valve. That is to say, the blocking device operates with hydraulic blocking which can be activated and deactivated by means of the valve of the blocking device. The valve may be designed as a valve with adjustable throughflow and/or as a shut-off valve. In preferred embodiments, the valve is designed as a shut-off valve, specifically preferably as an open/closed valve, and may in particular be designed as an electrically actuable valve, for example as an electromagnetic valve. The valve may however also be actuated by means of a mechanical actuating element or hydraulically or pneumatically.

In particular in embodiments with a hydraulic blocking device, embodiments are possible in which the position of a blocking element which interacts with the door opener catch can be positioned in any desired position in the blocking position. The blocking element can be actuated by means of the hydraulic circuit of the blocking device, specifically directly or indirectly if an interposed gearing is provided. The blocking and release of the blocking element takes place by means of the remote-actuable valve of the blocking device. As hydraulic medium, use may be made of different liquids, for example rheological liquids. Here, the blocking element may be designed as a working piston, for example may be connected to a piston of a piston-cylinder device of the hydraulic or pneumatic system. The working piston can be controlled by means of the valve of the blocking device. It is preferably provided that the working piston or a part which is connected to the working piston interacts with the door opener catch in an abutting manner, or interacts with the door opener catch via an interposed transmission gearing.

As restoring devices for the door opener catch, consideration is given to restoring devices which act on the door opener catch directly, that is to say independently of the blocking element. It is however additionally or alternatively also possible for the restoring device to act on the hydraulic medium of the hydraulic circuit. In these embodiments, the restoring device can ensure the restoring of the working piston which forms the working element or which is connected to the blocking element.

In embodiments with a hydraulic blocking device and/or hydraulic or pneumatic actuating device, it is possible in a particularly simple manner for the blocking element or the working piston of the door opener catch to be made to perform a follow-up movement during or after the closing of the door. The automatic actuating device provided for this purpose may be formed solely by the restoring device which has a force store, or else alternatively or additionally by a separate drive device, for example a separate farce store device which is loaded during the opening of the door and/or during the closing of the door, for example a spring device and/or a motor device, preferably electric motor device, which can be operated using external energy.

The blocking element which can be made to perform a follow-up movement can, in certain embodiments, be designed purely as a blocking element, the sole function of which is to arrest the door opener catch in the blocking position and to release the door opener catch in the release position. Other embodiments are however also possible in which the blocking element is designed as an element which restores the door opener catch.

Preferred embodiments are provided in which the restoring device is designed as a hydraulic device which is connected into the hydraulic circuit and which has a compensating cylinder and a compensating piston which is guided therein and acted on by the force store, for example a restoring spring. In these embodiments, it may advantageously be provided that the force store which interacts with the compensating piston is dimensioned such that, during the opening of the door, said force store builds up a hydraulic pressure capable of restoring the working piston into the blocking position or moving the working piston together with the door opener catch into the position in which the door opener catch abuts firmly against the lock catch in the closed position of the door. In the latter case, the self-adjustment of the door opener catch would take place via the device which also effects the follow-up movement of the blocking element.

In particularly preferred embodiments, the door opener catch is specially designed for the purpose of self-adjustment. In this connection, it may be provided that the door opener catch has a bearing body and a catch body which is movably guided on the bearing body during the closing of the door and/or during the opening of the door. In preferred embodiments, it is provided here that the catch body is guided in a linearly displaceable manner on the bearing body.

Particularly simple and at the same time functionally reliable embodiments are those in which it is provided that the catch body is designed as a substantially female component and the bearing body is designed as a substantially male component. The catch body can in this way be particularly advantageously guided in a displaceable manner on the bearing body.

In preferred embodiments, the bearing body is movably, preferably pivotably guided in the bearing body. Advantageous embodiments are however also possible in which the bearing body is mounted in an immovable manner in the door opener housing. In particular, in these embodiments, a lock catch actuating body is advantageously provided in the door opener housing, which lock catch actuating body is arranged such that, during the closing of the door, the lock catch can be caused to retract by interaction with the look catch actuating body.

To obtain particularly precise control of the movement of the catch body relative to the bearing body, it may be provided that an arresting device is provided which acts between the bearing body and the catch body, which arresting device can be deactivated during the actuating movement by interaction with the lock catch. The arresting device may preferably have a two-armed, spring-loaded switching lever which is pivotably mounted on the catch body and which has, at its first end, a stop for the lock catch, and at its second end, an arresting end for detachable engagement with the bearing body. It may be provided that the arresting end of the switching lever and the bearing body have a detent toothing for detachable engagement with one another.

For particularly functionally reliable interaction with the lock catch, it may be provided in preferred embodiments that the catch body has a rigidly connected driver which has a run-on side for interaction with a bevel of the lock catch and a driver side for contact against the lock catch during the actuating movement. In a preferred refinement, it may be provided here that the bearing body is arranged in an immovable manner in the door opener housing and a lock catch actuating body is arranged in the door opener housing in such a way that, during the closing of the door, the lock catch can be caused to retract by interaction with the lock catch actuating body. The driver is preferably arranged on the catch body in such a way that the lock catch, when deployed again after having been retracted, comes into contact with the driver.

For advantageous actuation of the door opener catch which has a bearing body and a catch body which is movable relative thereto, preferred embodiments are provided in which the door opener catch, preferably the catch body, has a drive-input-side section on which the drive output element of the actuating device and/or of the blocking device engages in such a way that the catch body is driven or blocked in the direction of the actuating movement. The drive-input-side section of the door opener catch may preferably have a wedge surface, and the drive output element may preferably have a wedge surface which interacts therewith.

In preferred embodiments, the drive output element is designed as a linear thrust element which interacts with the drive-input-side section of the door opener catch. The drive input element may be acted on in a hydraulic or pneumatic system with a hydraulic or pneumatic circuit. Alternatively or in addition, the drive output element may be acted on indirectly or directly by the drive output element of an electromechanical motor, preferably rotary motor.

In particularly preferred embodiments, it is provided that the door opener catch and/or a catch body, which is movable on a bearing body, of the door opener catch interacts with a drive output element of the actuating device and/or of the blocking device via a ratchet mechanism which can be controlled by means of an electromechanical motor unit and/or an electric lifting magnet unit.

Exemplary embodiments will be explained below on the basis of figures, in which.

Figure 10A:
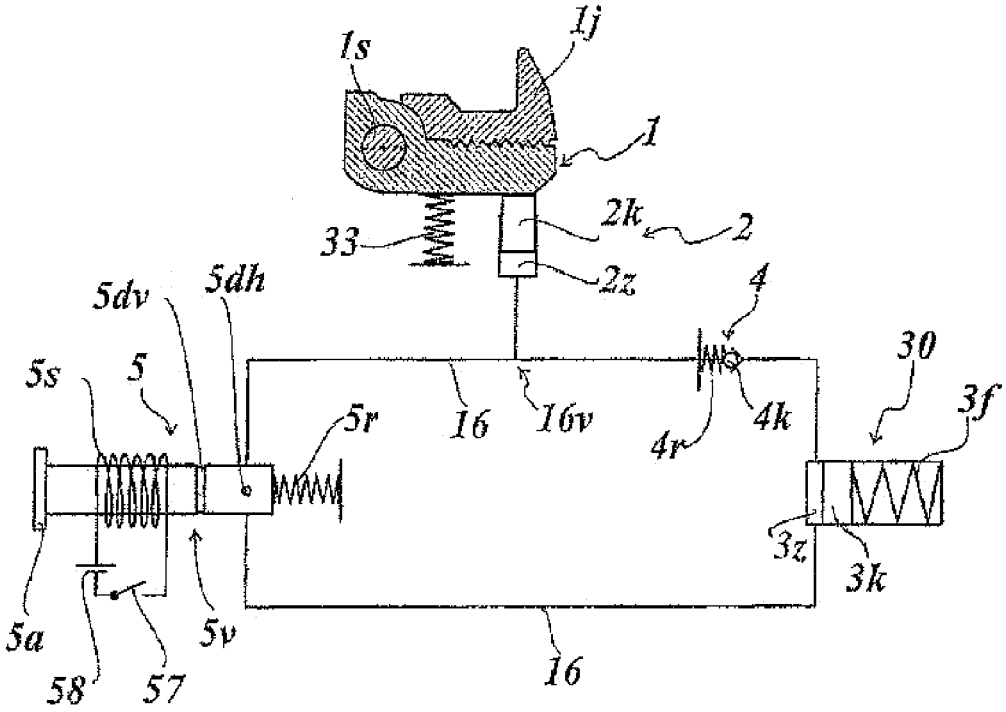
Figure 10B:
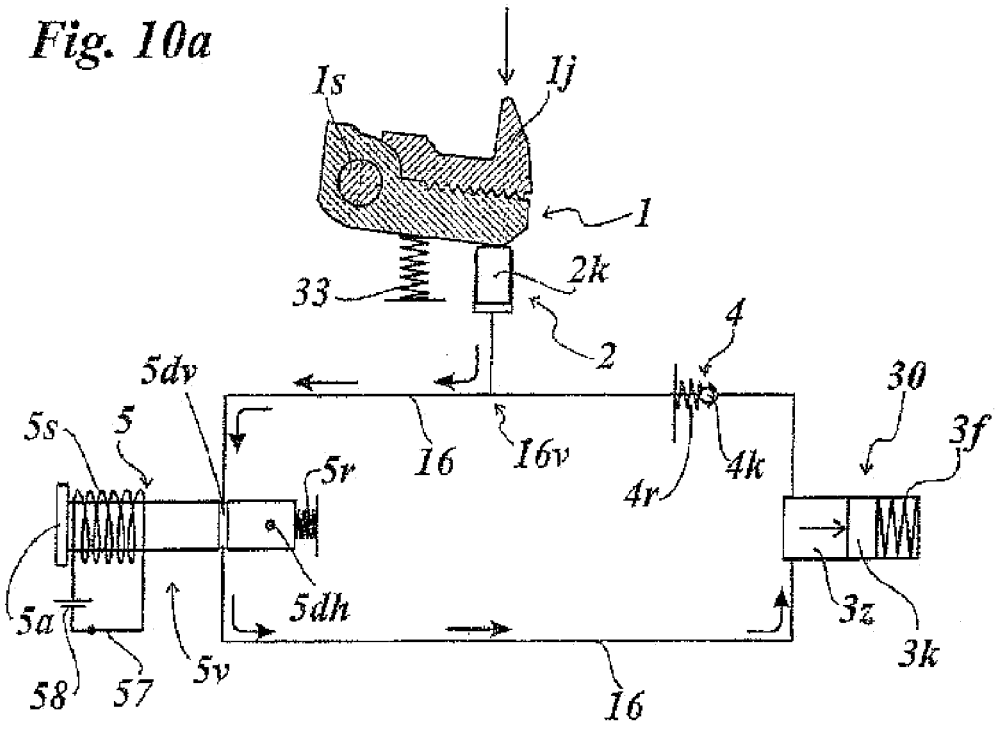
Figure 10C:
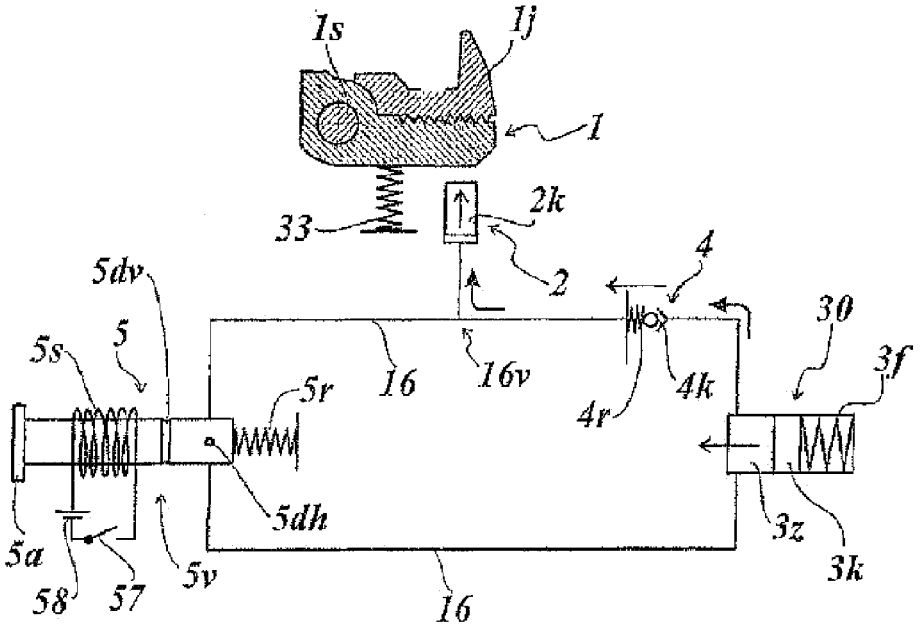
Figure 13:
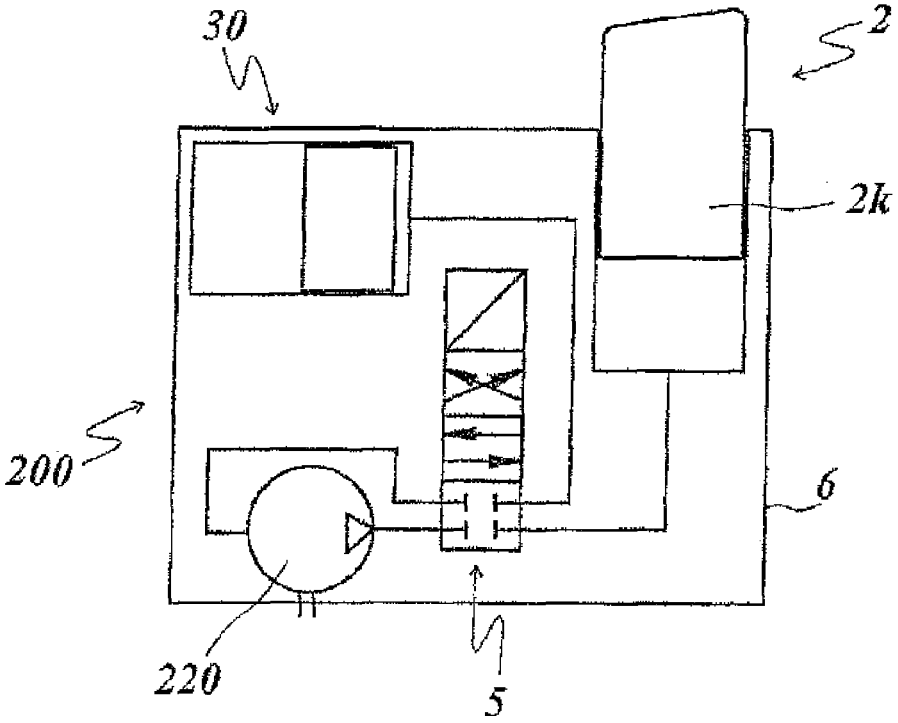

FIG. 7.1 shows a schematic view of the design of a seventh exemplary embodiment of a door opener according to the invention, in this case with stepped or continuously variable linear self-adjustment of a pivoting catch with positive guidance by means of a guide cam, in the blocking position;

FIG. 7.2 shows a view of the exemplary embodiment in FIG. 7.1, but with the door opener catch moved into a release position and fixed by means of a holding device;

FIG. 8.1 shows a schematic view of the design of an eighth exemplary embodiment of a door opener according to the invention, with stepped or continuously variable linear self-adjustment of the linearly movable door opener catch with guidance of the lock catch on the door opener housing, in the blocking position;

FIG. 8.2 shows a view of the exemplary embodiment in FIG. 8.1, but with the door opener catch moved into the release position and fixed, during the triggering of the holding device by the lock catch;

FIG. 9.1 shows a schematic view of the design of a ninth exemplary embodiment of a door opener according to the invention, with stepped or continuously variable linear self-adjustment with an actuating slide for the lock catch, in the blocking position;

FIG. 9.2 shows a view of the exemplary embodiment in FIG. 9.1, but during the actuation of the lock catch by the actuating slide during the opening of the door;

FIG. 10*a* shows a circuit arrangement of the components of the door opener in FIG. 10, in the blocking position;

FIG. 10*b* shows the circuit arrangement in FIG. 16*a*, but in the release position;

FIG. 10*c* shows the circuit arrangement in FIG. 16*a*, but at the transition into the blocking position;

FIGS. 11*a* to 11*d* show a further exemplary embodiment of the device according to the invention with a special door opener catch with displaceable catch body;

FIGS. 12*a* to 12*d* show yet a further exemplary embodiment of the device according to the invention with a door opener catch modified in relation to FIG. 11;

FIG. 13 shows a first exemplary embodiment of the actuating device in FIGS. 11*a* to 12*d;*

Figure 14:
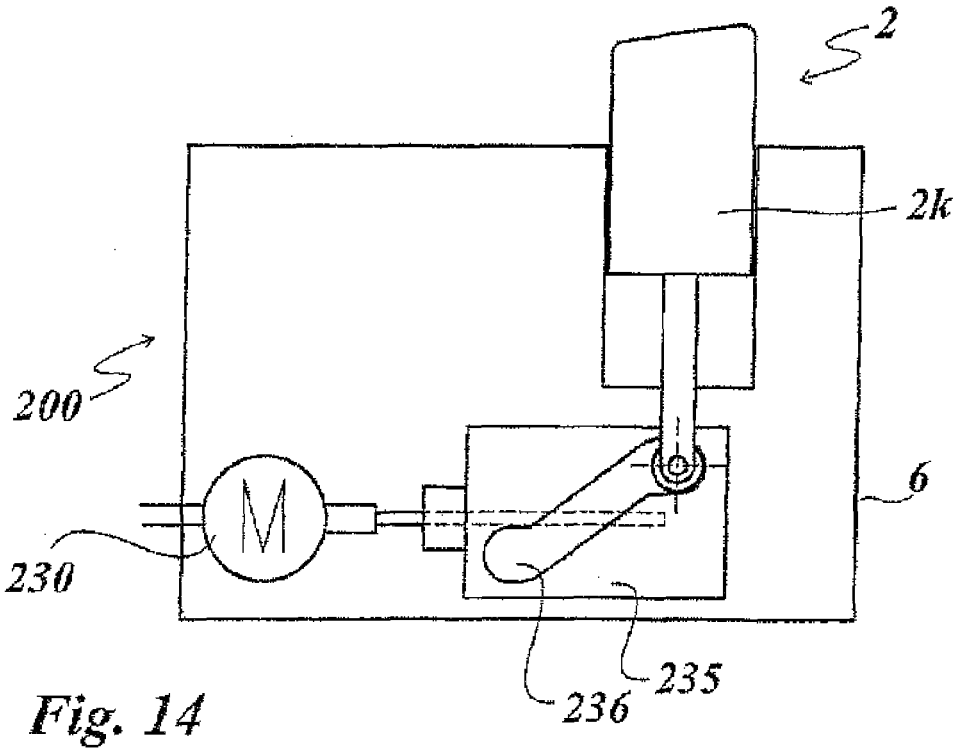

FIG. 14 shows a second exemplary embodiment of the actuating device in FIGS. 11*a* to 12*d;*

Figure 15:
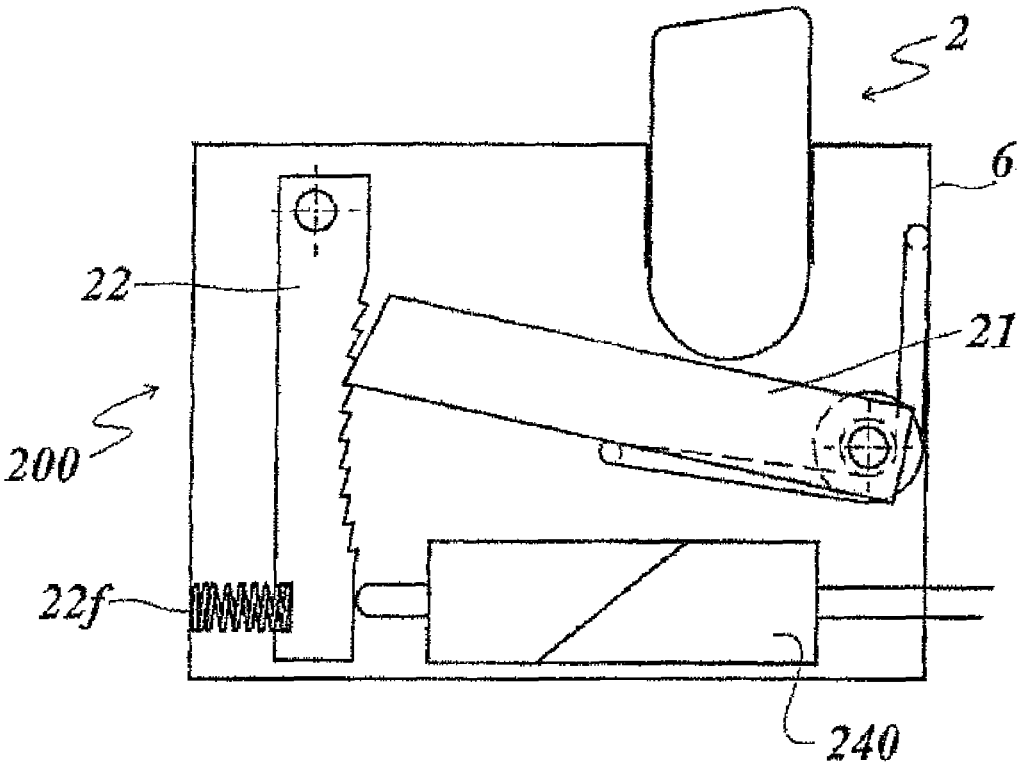

FIG. 15 shows a third exemplary embodiment of the actuating device in FIGS. 11*a* to 12*d.*

Figure 1:
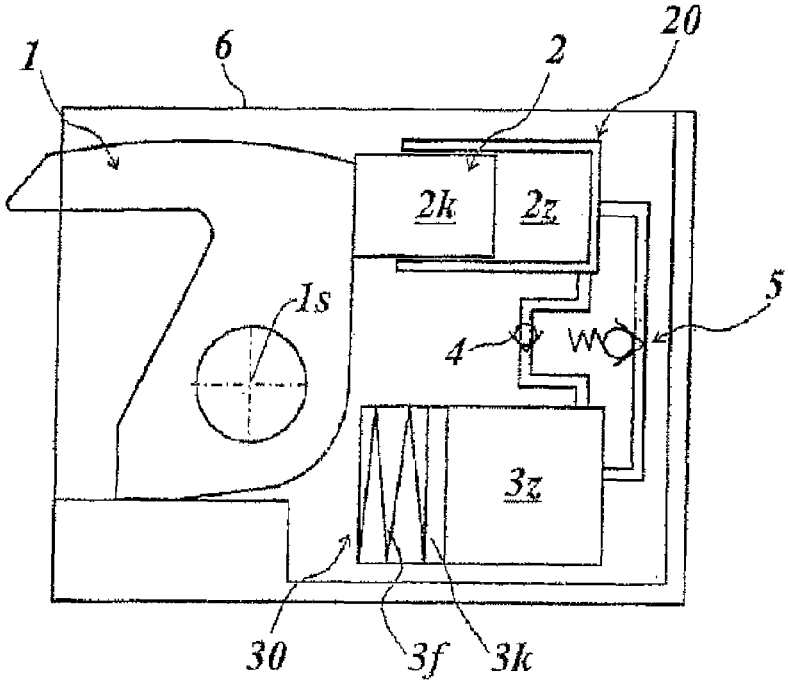
FIG. 1 shows a schematic view of the design of a first exemplary embodiment of a door opener according to the invention.

FIG. 1 shows a schematic view of a door opener with hydraulic fixing of the blocking element 2 by means of an electrically actuable hydraulic valve 5. The door opener catch 1 is designed as a pivoting catch. The blocking element 2 is designed as a hydraulic piston 2*k* of the hydraulic circuit of the blocking device. The hydraulic piston 2*k* is guided, as a working piston, in a hydraulic cylinder 2*z* and forms a piston-cylinder device 20 of the hydraulic circuit of the blocking device. Also provided in the hydraulic circuit in addition to the piston-cylinder device 20 with the blocking element 2 designed as a hydraulic piston is a compensating tank 3*z* with a restoring spring 3*f*. Said piston-cylinder unit, which is acted on by the spring 3*f*, forms a hydraulic restoring device 30 of the blocking element. The hydraulic piston-cylinder unit 20 and the compensating tank 3*z*, that is to say the hydraulic restoring device 30, are connected—as shown in FIG. 1—via hydraulic ducts, with a check valve 4 being arranged in one hydraulic duct and with the valve 5 being arranged in the other hydraulic duct, which valve 5 can be electrically actuated in order to activate and deactivate the fixing of the piston 2.

The door opener is preferably mounted on the positionally fixed frame of a door. In the closed position of the door, the door opener catch 1 engages behind the lock catch or the like which is arranged on the door leaf. The lock catch is not illustrated in FIG. 1. The lock catch may be of conventional design, that is to say designed as a resilient catch with a run-on bevel by means of which the door opener catch 1 can push over the lock catch during the closing of the door, the lock catch finally engaging behind and abutting against said door opener catch in the closed position. In the abutting position, the lock catch abuts with its vertical stop surface against the door opener catch 1 situated in the blocking position.

In an alternative, reversed assembly situation, the door opener may be mounted so as to be fixed to the door leaf and correspondingly interact by means of the door opener catch with the lock catch or the like arranged on the positionally fixed frame.

In the exemplary embodiment according to the invention, it is essential that the blocking element 2 is in each case automatically made to follow up the door opener catch 1 during the closing of the door, and can be fixed in any desired end position of the door opener catch 1. The automatic restoring takes place under the action of the restoring spring 3*f*. The fixing takes place by means of the hydraulic blocking device 20. In the exemplary embodiment, so-called self-adjustment of the door opener catch 1 is achieved in that the door opener catch 1, for its actuating movement toward the lock catch, is actively driven by the blocking element 2 until the door opener catch 1, in its end position, abuts against the lock catch in the closed position of the door.

In the exemplary embodiment in FIG. 1, the hydraulic circuit is used for controlling the blocking element 2, that is to say the working medium of the circuit is hydraulic oil. Instead of hydraulic oil, use may be made of a similar liquid or else of a gaseous working medium, for example air.

The illustrated door opener may operate according to the closed circuit principle. In this case, the valve 5 is connected such that it is held closed when supplied with electrical current. That is to say, as long as the valve is electrically energized, the valve is closed, and therefore the blocking element 2 is arrested in its blocking position. When the electrical current is switched off, the valve opens.

As a variant, it is also possible for the door opener to be operated according to the open circuit principle. For this purpose, the valve must be connected such that it is opened when supplied with electrical current, that is to say, as long as the valve 5 is electrically de-energized it is closed, arresting the blocking element 2. When the valve 5 is electrically energized, it opens, releasing the blocking element 2.

A pressure relief valve may additionally be arranged in a hydraulic connecting duct, which pressure relief valve ensures that, if an overload acts on the door, the hydraulic fixing is released by virtue of the pressure relief valve being opened. The pressure relief valve may preferably be variably adjustable to a predetermined overload.

The door opener in FIG. 1 functions as follows:

In the closed position of the door, the door opener catch 1 engages behind the lock catch. As long as the valve 5 is closed, the blocking element 2, that is to say the working piston 2*k*, is hydraulically blocked so as to be prevented from moving to the right in FIG. 1, and as a result the door opener catch 1 is simultaneously also fixed, that is to say said door opener catch is in its so-called blocking position. Said door opener catch 1 is fixed and therefore blocked such that, in the illustration in FIG. 1, it cannot rotate clockwise. Said door opener catch 1 therefore holds the lock catch (not illustrated) in the abutting position. As long as this blocking action is exerted by the door opener catch 1, the door cannot be opened.

Only when the valve 5 is opened by electric actuation is the blocking position of the door opener catch 1 eliminated, that is to say said door opener catch passes into the release position. This means that said door opener catch is released such that it can rotate about its pivot axis 1*s* clockwise in FIG. 1. During the opening of the door, the door opener catch is turned out of abutment by means of the lock catch of the door. During said rotation of the door opener catch 1, the blocking element 2, that is to say the working piston 2*k* of the hydraulic piston-cylinder device 20, is moved to the right in FIG. 1. Here, the hydraulic medium is moved in the hydraulic circuit so as to flow through the hydraulic line of the open valve 5 and into the compensating cylinder 3*z* of the hydraulic piston-cylinder device 30 which is acted on by means of the restoring spring 3*f*. The spring piston 3*k* is therefore acted on so as to compress the restoring spring 3*f*, and is moved to the left in FIG. 1.

When the door opener catch 1 passes out of engagement with the lock catch during the opening process, the return flow of hydraulic medium takes place under the action of the restoring spring 3*f*. The oil return flow can flow hack through the flow duct of the valve 5 for as long as the valve 5 is open. If the valve 5 has however already closed, the oil return flow takes place through the check valve 4. Said check valve 4 opens automatically when loaded in the return flow direction, such that the oil return flow can pass through the line of the check valve 4. Under the action of the oil return flow, the working piston 2*k* of the hydraulic piston-cylinder device is restored into its closed position.

In the exemplary embodiment in FIG. 1, the restoring of the working piston 2*k* takes place, as already explained, under the action of the hydraulic restoring device 30. In the illustrated case, said force device 30 is a hydraulic piston-cylinder device 30 which is acted on by the restoring spring 3*k*, that is to say in this case, the only actual force-exerting means provided is the mechanical restoring spring 3*k*. Alternatively or in addition, however, said force device 30 may also have a motor actuated using external power. The explained restoring, that is to say follow-up movement, of the blocking element and also the explained self-adjustment of the door opener catch are effected by means of the force device with restoring spring 3*k* and/or external-power-actuated motor. Modifications of the exemplary embodiment are conceivable in which the automatic follow-up movement of the blocking element 2 is effected by means of the force device, but self-adjustment is not effected by means of said device.

In exemplary embodiments in which the door opener catch 1 does not have a separate restoring device, such as is the case in FIG. 1, the blocking element 2, that is to say the working piston 2*k*, over its entire movement during opening and closing, remains in each case permanently in abutment with the door opener catch 1. If the valve is closed, the door opener catch 1 is blocked so as to be prevented from moving in the release direction. Here, in the closed position of the door, the hydraulically blocked blocking element 2 is in abutment with the door opener catch 1, which in turn is engaged behind by the lock catch of the closed door and is in abutment with the latter.

Figure 2:
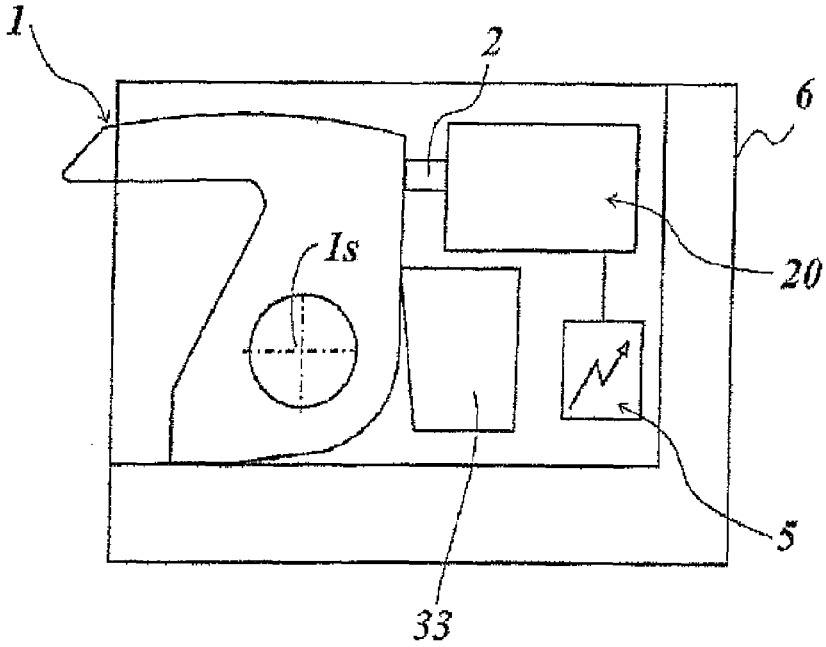
FIG. 2 shows a schematic view of the design of a second exemplary embodiment of a door opener according to the invention.

FIG. 2 shows an embodiment which is modified in relation to FIG. 1. The modification consists in that a restoring device 33 is provided which does not act on the door opener catch 1 via the hydraulic circuit and the blocking element 2, such as is the case in the hydraulic restoring device 30 provided in FIG. 1, but rather acts directly on the door opener catch independently of said blocking element. The restoring device 33 may be a helical compression spring which is supported with one end thereof on the door opener housing 6 and with the other end thereof on the door opener catch 1.

Figure 3:
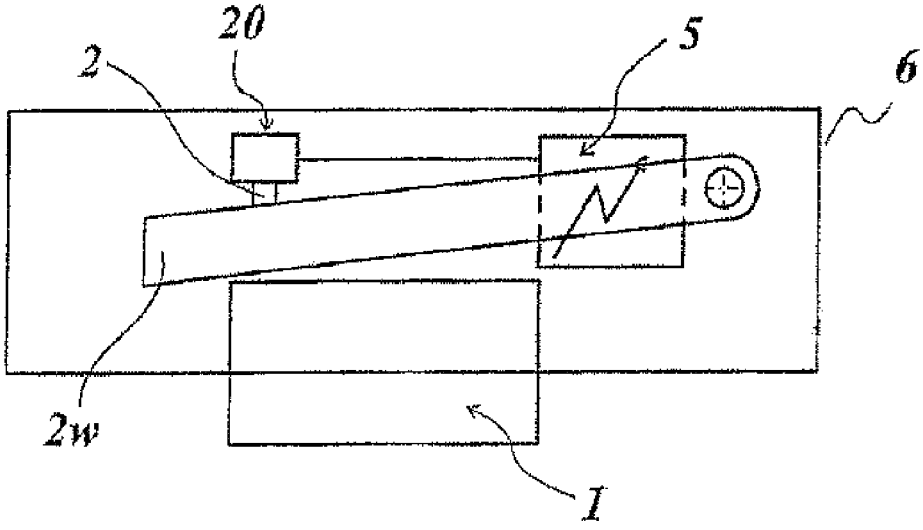
FIG. 3 shows a schematic view of the design of a third exemplary embodiment of a door opener according to the invention.

FIG. 3 shows an embodiment which is modified in relation to FIG. 1 and in which a one-armed lever 2*w* is connected between the hydraulically loaded blocking element 2 and the door opener catch 1. Said one-armed lever 2*w* is a so-called transition which acts as a transmission gearing between the blocking element 2 and the door opener catch 1.

Figure 4:
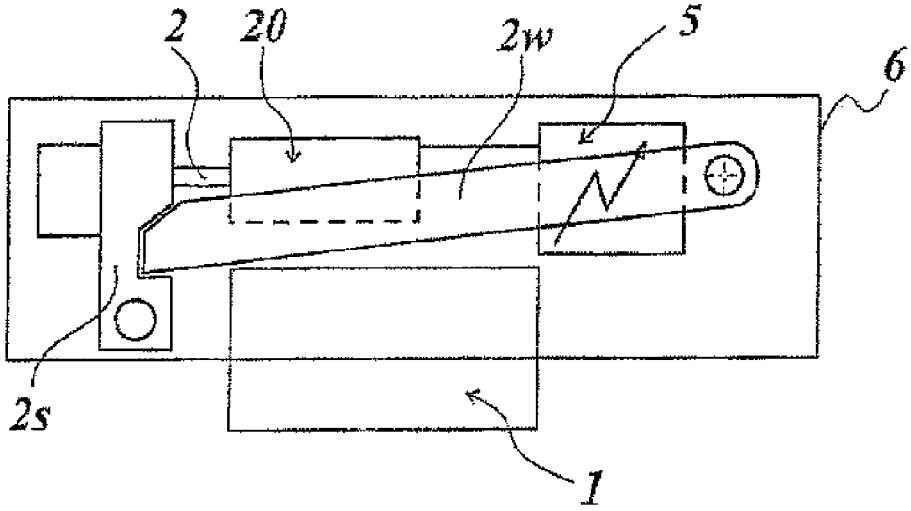
FIG. 4 shows a schematic view of the design of a fourth exemplary embodiment of a door opener according to the invention.

FIG. 4 shows an embodiment which is modified in relation to the exemplary embodiment in FIG. 3, wherein the modification consists in that a one-armed detent lever 2*s* is arranged between the hydraulically actuated blocking element 2 and the one-armed lever 2*w*, which one-armed detent lever 2*s* interacts with the hydraulically actuated blocking element 2. The detent lever 2*s* can be fixed and released by means of the hydraulically actuated blocking element 2.

A restoring device is not illustrated in FIGS. 3 and 4. The restoring device which is however provided may be designed to interact directly with the door opener catch 1, for example as a restoring device 33 as in FIG. 2, or may be designed to act on the catch via the hydraulic blocking element 2, for example as a hydraulic restoring device 30 as in FIG. 1.

Figure 5:
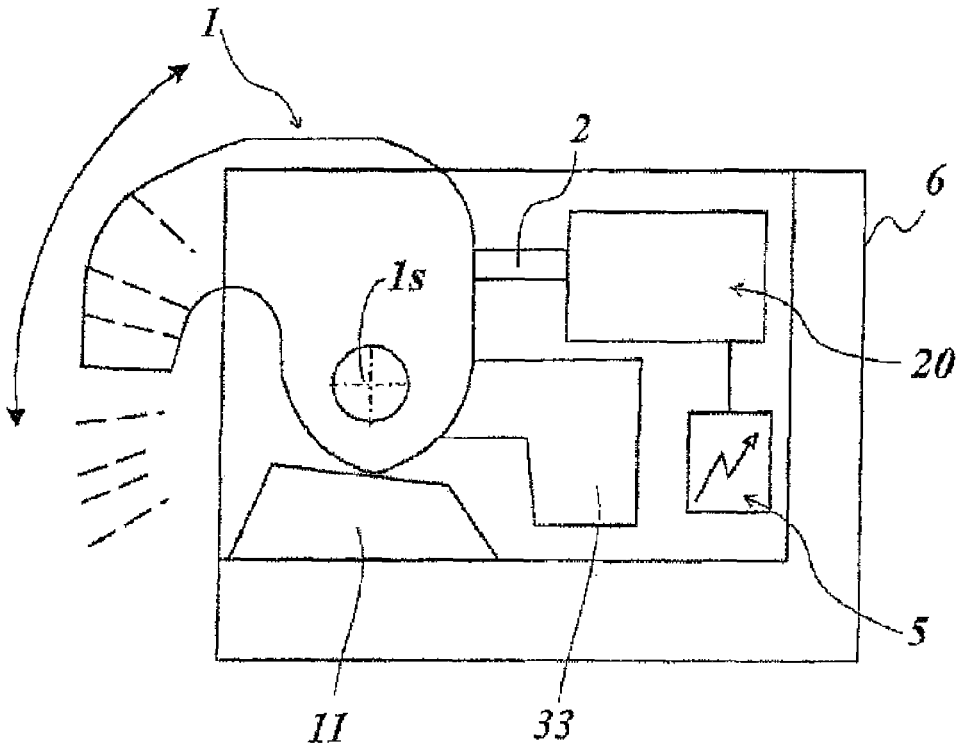
FIG. 5 shows a schematic view of the design of a fifth exemplary embodiment of a door opener according to the invention, in this case with a stepped or continuously variable self-adjustment of the door opener catch by means of rotating movement of the pivoting catch.

FIG. 5 shows a further exemplary embodiment in which it is provided that the hydraulically actuated blocking element 2 is in each case automatically made to follow up the door opener catch 1 in the closing direction, and is fixed in the followed-up position by means of the hydraulic valve 5 when the door opener catch 1 is in engagement with the lock catch in the closed position of the door. This means that the door opener catch 1 has automatic self-adjustment in this embodiment too. The conventional manual adjustment of the door opener catch, in which the adjustment of the door opener catch to the structural situation of the door during assembly or servicing of the door opener is effected by means of a manual alignment by virtue of an adjusting body—a so-called screw-on piece—on the basic body of the door catch being manually adjusted in each case, is thus no longer required in these embodiments. The reason for this is that the door opener catch 1 can be automatically adjusted into the respective position with respect to the lock catch, and the fixing of the blocking element 2 is possible in any desired followed-up position and takes place automatically.

In the embodiment in FIG. 5, the follow-up movement of the door opener catch 1 is effected by rotation of the pivoting catch 1 about its pivot axis 1*s*, driven by means of the restoring device 33. In this respect, there is a difference with respect to the embodiment illustrated in FIG. 1. It may however additionally be provided in the embodiment in FIG. 5 that the hydraulic blocking element, under hydraulic loading, effects not only the follow-up movement of the blocking element 2 but rather also the restoring of the door opener catch 1.

Also provided in FIG. 5 is an intermediate stop 11 which interacts with the lock catch 1. Said intermediate stop 11 may be designed as a memory device which holds the door catch 1 fixed in an intermediate position after the opening of the door, and which is released, preferably in a manner actuated by the lock catch, during the closing of the door in order then to enable the automatic readjustment and alignment of the lock catch 1, as described above.

The restoring device 33 in FIG. 5 may, like the restoring device 33 in FIG. 2, be designed as a preloaded mechanical spring device which is loaded during the opening of the door and which then automatically restores the door opener catch 1 during the closing of the door. The preload of the restoring device 33 ensures that it places the door opener catch in each case into the position of abutment with the lock catch in the closed position of the door. In addition or alternatively, however, the restoring device 33 may also have a motor drive which uses external power, for example an electric motor unit.

Figure 6:
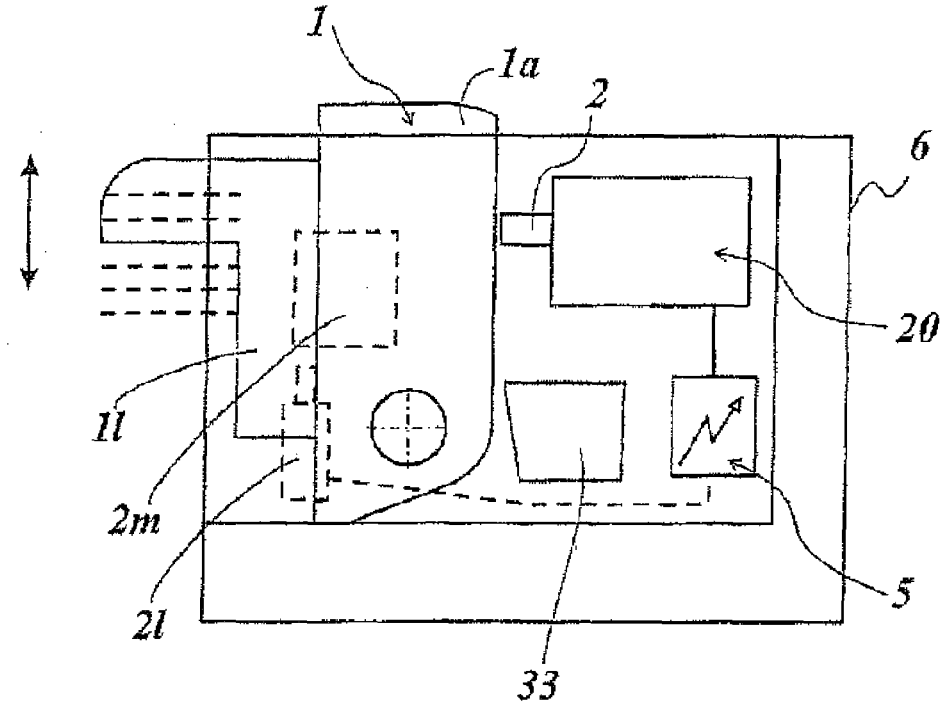
FIG. 6 shows a schematic view of the design of a sixth exemplary embodiment of a door opener according to the invention, in this case with a stepped or continuously variable self-adjustment of the two-part door opener catch with linear self-adjustment of the linearly movable part of the pivoting catch.

FIG. 6 shows an exemplary embodiment which is modified in relation to the exemplary embodiment in FIG. 5. The modification consists in that the door opener catch 1 is in this case designed as a pivoting catch with a pivotable basic body 1*a* and a linearly movable catch body 1*b*. The pivotable basic body 1*a* interacts with the hydraulically actuated blocking element 2. The linearly movable catch body 1*b* is acted on by means of an actuating device 2*l* in order to place the linearly movable catch body 1*l* into engagement with the lock catch and fix it there. The actuating device 2*l* is connected to the hydraulic circuit of the blocking element 2 and is likewise released by means of the hydraulic valve 5. This actuating device 2*l* may be connected to a memory device 2*m*. The actuating device 2*l* may be designed as an automatic spring device or else as a motor unit actuated using external power.

FIGS. 7.1 and 7.2 show an exemplary embodiment which is modified in relation to the exemplary embodiment in FIG. 5. The modification consists in that the door opener catch 1 is in this case designed as a catch which is positively guided by means of a guide cam 1*f*.

In this exemplary embodiment, a holding device 12 is also provided which arrests the door opener catch 1 in the open position after the opening of the door, as shown in FIG. 7.2. Said arresting action is then eliminated during the closing of the door. For this purpose, the holding device 12 has a release element 12*a* which is actuated by the lock catch during the closing of the door.

FIGS. 8.1 and 8.2 show an exemplary embodiment which is modified in relation to the exemplary embodiment in FIGS. 7.1 and 7.2. The modification consists in that, in this case, the door opener catch 1 is designed as a linearly displaceable catch and a lock catch guide 6*a* for the lock catch 90 is provided on the door opener housing 6. During the opening of the door, the door opener catch 1 is moved upward, into the position illustrated in FIG. 8.2, under the action of the lock catch 90. The lock catch guide 6*a* has the effect that, during the opening of the door, the lock catch 90 finally passes out of engagement.

In the position illustrated in FIG. 8.2, the door opener catch 1 is fixed by means of the holding device 12 and remains in said position for as long as the door is open. When the door is closed, the release element 12*a* of the holding device 12 is then actuated by means of the lock catch 90 in the direction of a release of the holding device. The door opener catch 1 then moves downward, under the action of the hydraulically actuated blocking element 2, into the blocking position illustrated in FIG. 8.1. When the door is closed, the lock catch 90 engages under the blocking edge of the door catch 1 with optimum engagement on account of the continuously variable follow-up movement and fixing which has been effected by the blocking element.

FIGS. 9.1 and 9.2 show an exemplary embodiment which has been modified in relation to the exemplary embodiments in FIGS. 8.1 and 8.2. The modification consists in that, in this case, no lock catch guide 6*a* is provided, but rather a lock catch actuating device is provided which pushes the lock catch 90 back during the opening process, via a preferably hydraulically actuated plunger. The lock catch actuating device 19 may be connected to the hydraulic device of the blocking device. Said lock catch actuating device 19 may however also be formed as a separate motor device, for example as an electric motor.

The automatic follow-up movement of the blocking element in the hydraulic door opener, and the automatic self-adjustment of the door opener catch, will be explained in detail once again below on the basis of the schematic circuit diagrams 10*a*, 10*b* and 10*c*. The circuit diagrams show the hydraulic circuit with the components of the door opener. The circuit diagram 16*a* shows the door opener in the blocking position. The circuit diagram 10*b* shows said door opener in the release position, and the circuit diagram 16*c* shows the door opener in the transition position at the transition into the blocking position. The components of the door opener used as a basis in these circuit diagrams are illustrated in each case schematically in the circuit diagrams. The components are components which have already been explained in conjunction with the preceding exemplary embodiments of FIGS. 1 to 9. Illustrated are a door opener catch 1 and a hydraulic blocking device with a hydraulic circuit. Connected in the hydraulic circuit are a hydraulic piston-cylinder device 20 with hydraulic working piston 2*k*, a hydraulically acting restoring device 30, an electrically actuable shut-off valve 5, and a check valve 4.

In the illustrated exemplary embodiment, the piston 2*k* of the hydraulic piston-cylinder device 20 forms the blocking element 2 which interacts directly with the door opener catch 1.

The hydraulic spring store device 30 is composed of a hydraulic compensating cylinder 3*z* in which a spring piston 3*k*, which is acted on by a helical compression spring 3*f*, is guided as a compensating piston. The helical spring 3*f* forms the restoring spring which ensures that the working piston 2*k* which forms the blocking element 2 is automatically restored into its blocking position after the opening of the door. This automatic restoring of the blocking element thus takes place under the action of the hydraulic spring store device 30. The latter is connected via the hydraulic circuit to the piston-cylinder unit 20, the working piston 2*k* of which interacts, as a blocking element, with the door opener catch 1. The hydraulic spring store device 30 is designed such that the blocking element 2 or the working piston 2*k* is in each case permanently made to perform a follow-up movement so as to be in abutment with the door opener catch 1.

In the illustrated case, the door opener catch 1 is designed as a pivoting catch pivotable about its pivot axis 1*s*. Said door opener catch has a so-called screw-on piece 1*j*. The screw-on piece 1*j* has an L-shaped form in cross section and can be fixed by means of screws (not illustrated) to the basic body of the door opener catch 1 in different positions by way of ribs, that is to say in an alignable manner in order to adapt the door opener catch 1 to the structural conditions. During the alignment, the adjustment is carried out such that the door opener catch 1 engages with its screw-on piece 1*j* behind the lock catch in the closed position of the door, and in so doing bears in a rattle-free manner against the lock catch. In the illustrated exemplary embodiment, said alignment with the screw-on piece 1*j* may be carried out as a rough pre-alignment, because an adjusting device is also provided by means of which the door opener catch 1 is automatically placed in rattle-free abutment with the lock catch.

In the illustrated situation, the door opener catch 1 interacts for this purpose with a restoring spring 33 which is supported with one end thereof directly against the door opener catch and with the other end thereof in the door opener housing 6. By means of said restoring spring 33, it is ensured that the door opener catch 1 is restored into its closed position again in each case after the opening of the door, in which closed position said door opener catch 1 is engaged behind by the lock catch, so as to be in abutment therewith, when the door is closed. The restoring spring 33 is designed such that the door opener catch is self-adjusting during operation, that is to say the door opener catch abuts in a rattle-free manner against the lock catch in each case in the closed position of the door.

Instead of the restoring spring 33 or in addition thereto, said action may also be imparted by the hydraulic spring store device 30 or a motor unit (not illustrated in FIG. 10) which is actuated using external power. Such a motor unit may be connected, as a hydraulic pump, into the hydraulic circuit or may also act, as an electromechanical motor, via a gearing on the blocking element or directly on the door opener catch 1.

The self-adjustment of the door opener catch may preferably be designed such that the door opener catch can perform, in an actively driven manner, a stroke of 5 mm. Embodiments with a larger stroke are also possible. In said embodiments in particular, for example with a driven stroke of 10 mm (15 mm), the door leaf is pulled into the closed position. In these embodiments, the door opener acts, so as to pull the door leaf closed, as a capture element which can be decoupled from and coupled to the lock catch or some other corresponding counterpart element and which, for pulling closed, can be placed in engagement anew in each case in the respective end region of the closing movement during every closing process.

The check valve 4 in the circuit in FIGS. 10*a* to 10*c* is composed of a blocking ball 4*k* which is loaded by a helical compression spring 4*r*. The check valve 4 is connected between the hydraulic spring store device 30 and the hydraulic piston-cylinder device 20. The check valve 4 can be traversed by flow in only one direction, from the right to the left in FIGS. 10*a* to 10*c*, and thereby ensures that the hydraulic medium in the hydraulic circuit can flow from the piston-cylinder device 20 to the hydraulic spring store device 30 only via the valve 5 and cannot pass directly to the hydraulic spring store 30 while bypassing the valve 5.

A significant control component of the hydraulic circuit is the shut-off valve 5. In the illustrated case, said shut-off valve has a valve plunger 5*v* which is arranged in a cylindrical magnet coil 5*s* and which is rigidly connected at the end side to a plate-shaped magnet armature 5*a*. The valve plunger 5*v* is supported on a restoring spring 5*r*. The magnet coil 5*s* is connected via a switch 57 to a voltage source 58. The valve plunger 5*v* which is connected to the magnet armature 5*a* is pulled into the magnet coil 5*s* when the switch 57 is closed. The restoring spring 5*r* is thereby compressed. The valve plunger 5*v* extends with its rear end section, which faces away from the magnet armature 5*a*, through the hydraulic connecting line 56 and, there, has two through holes which are arranged axially one behind the other and perpendicular to the longitudinal axis and in a crossed fashion at 90° to one another. A front through hole 5*dv* faces toward the magnet armature 5*a*, and a rear through hole 5*dh* faces toward the rear end section. The axial spacing between the two through holes corresponds to the working stroke of the valve plunger 5*v*.

In the situation illustrated in FIGS. 10*a* to 10*c*, the shut-off valve 5 is connected as an open circuit valve, that is to say the door opener catch 1 is released when the switch 57 is closed.

When the switch 57 is open as illustrated in FIG. 16*a*, the door opener catch 1 is blocked. Although the rear through hole 5*dh* is situated in the plane of the connecting line 16, it cannot connect to one another those two partial sections of the connecting line 16 which adjoin the valve plunger 5*v*, because the longitudinal axis of said rear through hole is not aligned with the longitudinal axis of the connecting line 16.

When the switch 57 is closed as illustrated in FIG. 10*b*, the valve plunger 5*v* is pulled into the magnet coil 5*s*. The front through hole 5*dv* engages into the connecting line 16 and connects to one another those two partial sections of the connecting line 16 which end on the surface of the valve plunger 5*v*. The shut-off valve 5 is open.

As can be seen in the circuit diagrams 10*a*, 10*b* and 10*c*, during the pivoting of the released door catch 1 by the lock catch of the door, the working piston 2*k* is pushed into its cylinder and the compensating piston 3*k* is acted on with pressure on account of the open shut-off valve 5. The compensating piston 3*k* is moved back and the restoring spring 3*f* which engages on the compensating piston 3*k* is compressed.

The restoring spring 33 which engages on the door opener catch 1 is also compressed. Said restoring spring 33 restores the door opener catch 1 into the blocking position as soon as the lock catch has passed out of engagement with the door opener catch.

If the switch 57 is now opened again, as illustrated in FIG. 10*c*, and therefore the shut-off valve 5 is closed, the restoring spring 3*f* which engages on the compensating piston 3*k* pushes the compensating piston 2*k* into its initial position. As a result of the increase in pressure in the connecting line 16 between the compensating piston 3*k* and the check valve 4, the check valve 4 now opens, as a result of which the pressure increases in the connecting line 16 between the check valve 4 and the working piston 2*k*, and the working piston 2*k* is placed into its initial position. The check valve 4 prevents the hydraulic pressure which acts on the working piston 2*k* from being dissipated again. The blocking device 2 is blocked again.

It is also possible for the restoring spring 33 which engages on the door opener catch 1 to be dispensed with, and for the restoring spring 3*f* which engages on the compensating piston 3*k* to be dimensioned such that the door opener catch 1 is restored by the working piston 2*k*.

Below, in conjunction with FIGS. 11 to 15, exemplary embodiments will be described in which the door opener catch is specially designed for the purpose of self-adjustment, and the door opener catch interacts with the blocking element of the door opener so as to realize the basic functions of a door opener, specifically to realize blocking and releasing and also to realize a self-adjustment of the door opener catch.

FIGS. 11*a*, 11*b*, 11*c*, 11*d* show an exemplary embodiment of said type. The door opener catch 1 interacts with a drive output element 2 of an actuating device 200. The actuating device functions as a motor unit for the self-adjustment of the door opener catch 1. The actuating device 200 also forms the blocking device of the door opener, by means of which the door opener catch 1 can be arrested when the door is in the closed position.

The structural unit composed of door opener catch 1 and actuating device 200 is arranged in a common housing 6. The door opener catch 1 has a pivotably mounted bearing body 110 with a pivot axis 110*s*, which bearing body is engaged around by a displaceable catch body 10. The catch body 10 has a through hole which may for example have a rectangular cross section, as in the exemplary embodiment illustrated in FIGS. 11*a* to 11*d*, and through which the bearing body 110 extends. At its end section facing away from the pivot axis 110*s*, the catch body 10 has a hook-shaped driver 10*m* which points upward and interacts with a lock catch 90 of a door leaf (not illustrated in FIGS. 11*a* to 11*d*).

A pivotably mounted arresting lever 10*h* is arranged on the movable catch body 10, with the arresting lever 10*h* being arranged on that side of the catch body 10 which faces toward the door leaf and with the pivot axis of the arresting lever 10*h* being aligned parallel to the pivot axis 110*s* of the bearing body. A first end section of the arresting lever 10*h* is designed as a stop end 10*a* and interacts with the lock catch 90. A second end section of the arresting lever 10*h* is designed as an arresting engagement end 10*e* and interacts with sawtooth-shaped detent recesses formed on the catch body 10. In a section situated between the stop end 10*a* and the pivot axis of the arresting lever 10*h*, a compression spring 10*r* is arranged which presses the arresting engagement end 10*e* against the catch body 10. The arresting engagement end 10*e* may slide along a curved release stop 10*f* when no longer in engagement with the sawtooth-shaped detent recesses.

Formed on the catch body 10 on the underside, which faces away from the door leaf, of the catch body 10 is a wedge surface 10*k* which interacts with the drive output element 2 of the actuating device 200.

Figure 11A:
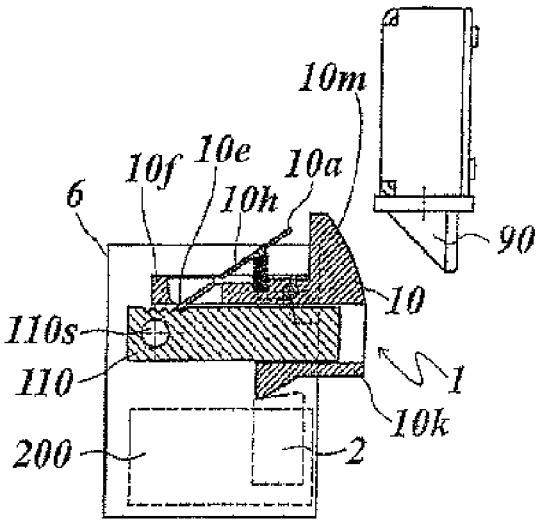

FIG. 11*a* now shows the device in a first position in which the lock catch 90 has not yet come into contact with the wedge surface K of the driver 10*m* of the catch body 10. The catch body 10 is arrested on the bearing body 110 because the arresting engagement end 10*e* of the arresting lever 10*h* engages into one of the sawtooth-like detent recesses of the bearing body 110.

Figure 11B:
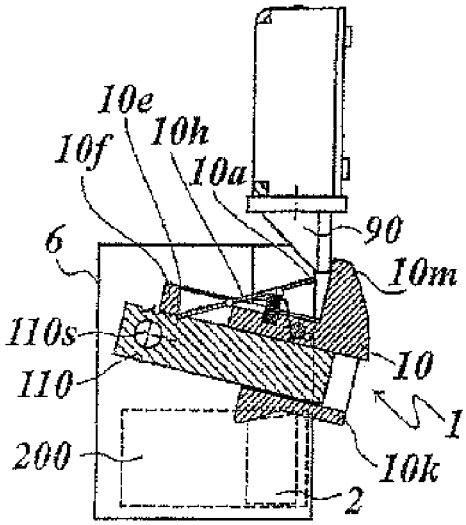

During the closing of the door leaf (see FIG. 11*b*), the lock catch 90 comes into contact with the driver 10*m* and thereby, by means of a switching device not illustrated in FIGS. 11*a* to 11*d*, triggers the drive of the actuating device 200, as a result of which the drive output element 2 is retracted into the actuating device 200 and the door opener catch 1 is pivoted in the closing position in FIG. 11*b*. Here, it may be provided that the lock catch 90 is pushed over before it falls behind the driver 10*m*, as illustrated in FIG. 11*b*. The door opener catch 1 is pivoted only to such an extent that, in said position of the door catch, the lock catch 90 still has a small spacing to the top side of the stop end 10*a* of the arresting lever 10*h*.

Figure 11C:
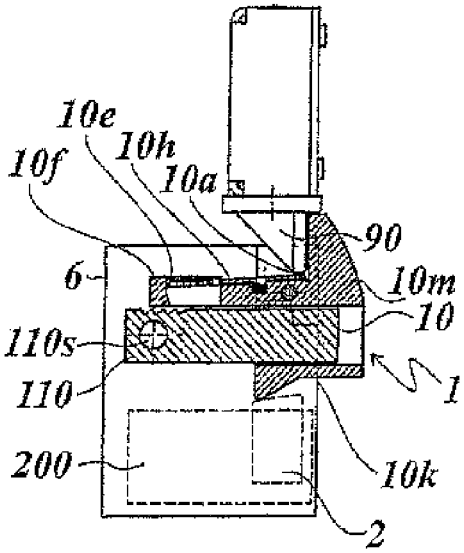
Figure 11D:
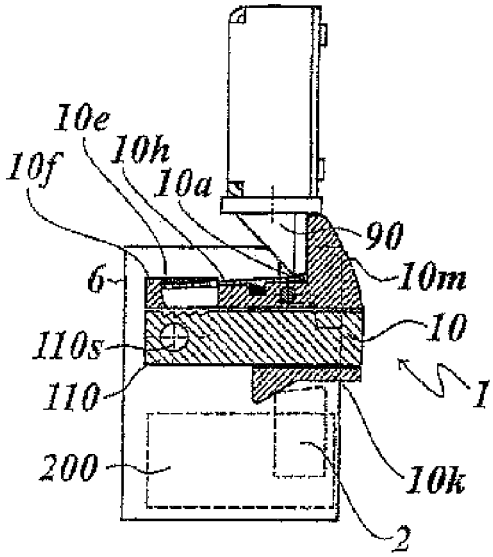
Figure 12A:
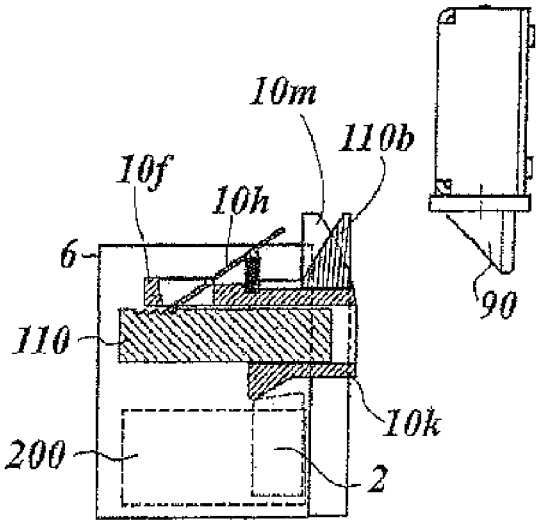
Figure 12B:
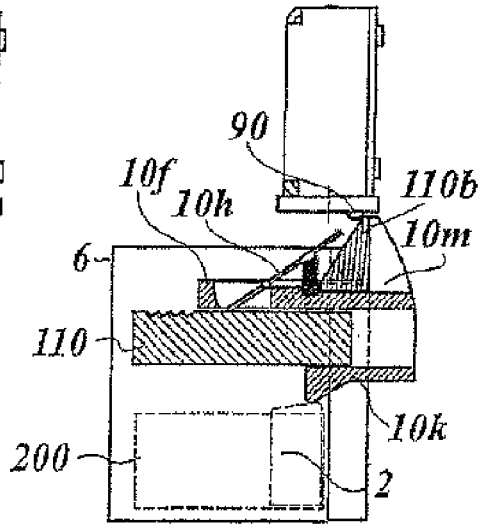
Figure 12C:
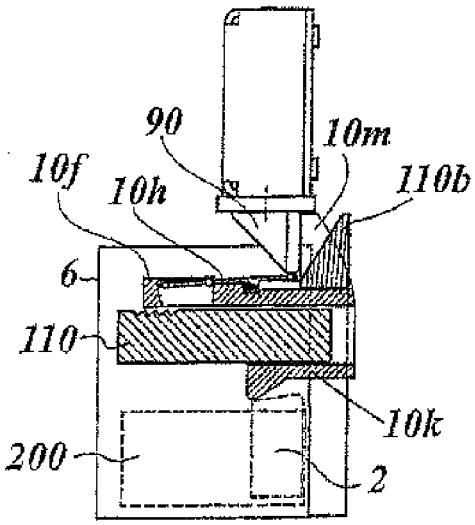
Figure 12D:
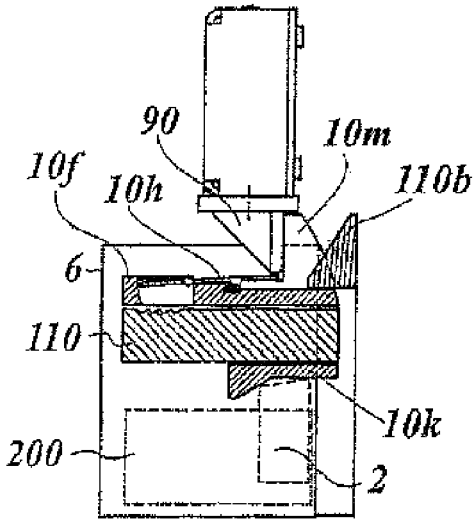

The drive output element 2 of the actuating device 200 is then actuated again and pivots the door opener catch back into its horizontal position in FIG. 11*c*. Here, the arresting lever 10*h* is pivoted to such an extent that it passes out of engagement with the detent recesses of the bearing body 110. The pressure spring 10*r* which engages on the arresting lever 10*h* is dimensioned such that the lock catch 90 is not pushed over during the pivoting of the arresting lever 10*h* (FIG. 11*c*).

The catch body 10 is now released again, such that the drive output element 2 of the actuating device 200, as it slides along the wedge surface 10*k* of the catch body, can push the catch body 10 back in the direction of the pivot axis 110*s*. Here, the door leaf is driven by means of the lock catch 90 until it bears against the door frame (not illustrated in FIGS. 11*a* to 11*d*) and the closed position of the door is assumed. In the closed position of the door, rattle-free contact of the catch body 10 against the lock catch 90 is obtained.

It is provided that the actuating device 200 also operates as a blocking device which prevents the door leaf from being pulled open. When the door opener catch 1 is released, it may be provided either that the actuating device 200 pulls the drive output element 2 back or that the drive output element 2 can be pushed over. In both cases, the positions illustrated in FIGS. 11*a* to 11*d* are run through in the reverse sequence, that is to say starting from the position illustrated in FIG. 11*d* to the position illustrated in FIG. 11*a*.

The actuating device 200 therefore forms a device for pulling the door leaf into its closed position. Said actuating device simultaneously forms a device for the self-adjustment of the door opener catch 1, by virtue of the device ensuring that the door opener catch 1 is automatically set into rattle-free abutment with the lock catch 90 in the closed position of the door.

During the opening of the door, the positions are run through in the sequence of FIGS. 11*d*, 11*c*, 11*b*, 11*a*. During the closing of the door, the positions are run through in the sequence of FIGS. 11*a*, 11*b*, 11*c*, 11*d*.

FIGS. 12*a* to 12*d* show a further exemplary embodiment, with the device being of substantially the same design as the device illustrated in FIGS. 11*a* to 11*d*, with the difference that a lock catch actuating body 110*b* is also provided, and that the bearing body is not pivotable but rather is arranged on the housing 6 in a positionally fixed manner. The lock catch actuating body 110*b* has a straight front surface and an oblique rear surface. The straight front surface of the lock catch interacts with the oblique surface of the door opener catch during closing, in order to push over the lock catch during closing. The oblique rear surface of the lock catch interacts with the rear straight section of the lock 90 during the opening of the door, in order to push over the lock catch 90 during opening. During the closing of the door, the positions are run through in the sequence of FIGS. 12*a*, 12*c*, 12*d*. During the opening of the door, the positions are nm through in the sequence of FIGS. 12*d*, 12*c*, 12*b*, 12*a*.

FIGS. 13 to 15 now show exemplary embodiments of the actuating device 200.

FIG. 13 shows an actuating device 200 based on hydraulics. The drive output element 2 is designed as a working piston 2*k* of a piston-cylinder device 20, which piston-cylinder device can be connected via a magnetic shut-off valve 5 to a hydraulic pump 220. The shut-off valve 5 has a valve plunger with three switching chambers which are arranged one behind the other in the longitudinal axis of the valve plunger. Furthermore, a hydraulic spring store device 30 is provided which can likewise be connected by means of the shut-off valve 5 to the hydraulic pump 220. The hydraulic pump 220 generates the required operating pressure in the hydraulic circuit.

In a first position of the shut-off valve 5, the connections of the piston-cylinder device and of the spring store device 30 to the hydraulic pump 220 are interrupted. The drive output element 2, that is to say the piston of the piston-cylinder device 20, is blocked so as to be prevented from being pushed into the cylinder. The door opener catch 1 is consequently blocked.

In a second position of the shut-off valve 5, the hydraulic pump 220 is switched into pressure operation with regard to the drive output element 2. When the pump 220 is activated, the drive output element 2 is pushed in the direction out of the cylinder. When the hydraulic pump 220 is deactivated, as the drive output element 2 is pushed into the cylinder of the piston-cylinder device 20, the spring of the spring store device 30 is stressed such that the drive output element 2, when not loaded or only lightly loaded, is pushed in the direction out of the cylinder of the piston-cylinder device under the action of the spring.

In a third position of the shut-off valve 5, the hydraulic pump 220 is switched into suction operation with regard to the drive output element 2. Consequently, the drive output element 2 is pulled into the cylinder of the piston-cylinder device 20 in the release position, and at the same time, the spring of the spring store device 30 is stressed.

FIG. 14 shows a second exemplary embodiment of the blocking device 200. An electromechanical rotary motor 230 drives a screw spindle gearing 235 whose drive output element, in the manner of a spindle nut running on the screw spindle, performs a linear movement along the longitudinal axis of the drive output shaft of the rotary motor 230 and has a Z-shaped guide cam 236. The drive output element 2 of the actuating device 200 is, as a piston, guided linearly in the cylinder and has, at its lower end section, a roller which rolls in the guide cam 236. The two end sections of the guide cam 236 are aligned perpendicular to the straight-line guidance of the drive output element 2, and are connected by means of an obliquely running guide section. As a result of the end sections, which are aligned perpendicular to the straight-line guidance of the drive output element 2, of the guide cam 236, this is a self-locking cam mechanism, with the screw spindle gearing 235 also being a self-locking gearing. Consequently, the door opener catch 1 is blocked in any position in the event of a power failure.

In the exemplary embodiment illustrated in FIG. 15, a ratchet mechanism is provided for moving the drive output element 2.

A first rotatably mounted spring-loaded lever 21 is designed as a pawl and interacts with the drive output element 2 of the actuating device 200. The lever 21 is pressed by means of a leg spring 21 against the rear circular-arc-shaped end section of the drive output element 2.

A second rotatably mounted spring-loaded lever 22 is arranged at an angle with respect to the first lever 21 and has, on the longitudinal side facing toward the lever 21, a circular-arc-shaped sawtooth-like ratchet section into which the pawl section of the lever 21 engages. A compression spring 22*f* is arranged between the end section, which faces away from the rotary bearing, of the lever 21 and the inner wall of the housing of the actuating device, which compression spring 22*f* engages on that longitudinal side of the lever 22 which faces toward the inner wall of the housing. Arranged on the opposite longitudinal side of the lever 22 is a lifting magnet 240, the longitudinal axis of which is aligned with the longitudinal axis of the compression spring 22*f* designed as a helical compression spring, and the linearly movable drive output element of which bears against the lever 22.

The recesses of the sawtooth-shaped ratchet section of the lever 22 have a shape congruent to the pawl section of the lever 21 and are aligned such that the drive output element 2 cannot be pushed back, that is to say cannot be lowered. The drive output element 2 is consequently blocked in one direction. The drive output element 2 can be unblocked by actuating the lifting magnet 240, with the pawl section of the lever 21 passing out of engagement with the sawtooth-shaped ratchet section of the lever 22 for the duration of actuation.

In the event of a brief actuation of the lifting magnet 240, the lever 21 is advanced in each case one tooth further in the direction of the drive output element 2, with the working capacity of the drive output element 2 being determined by the spring force of the leg spring 21*f*. In the event of a long-duration actuation of the lifting magnet 240, the leg spring 21*f* moves the drive output element 2 until the closed position of the door is reached, as described further above in FIGS. 11*a* to 11*d*. The leg spring 21*f* thus acts as an actuating motor, in this case as a spring motor.

As a particularly interesting design variant, it is also possible for the device in FIG. 15 to be designed purely as a blocking device. In this case, it is important for the spring force of the compression spring 22*f*, taking into consideration the lever ratios and the spring force of the leg spring 21*f*, to be low enough that the leg spring pushes the first lever 21 out of the detent recess—with the second lever 22 compressing the compression spring 22*f*—until the lever 21 bears against the actuating element 2 and, here, falls into one of the detent recesses. In the same way as in the embodiment of FIG. 15 described above, it is also the case in this design variant that the actuating element 2 is blocked until the lifting magnet 240 pivots the second lever 22 in the direction of the compression spring 22*f* and the first lever 21 falls out of, or at least passes out of engagement with, the detent recess when the blocking element 2, in the release position, is loaded in the downward direction in FIG. 15.

LIST OF REFERENCE SYMBOLS

1 Door opener catch
1*s* Pivot axis
1*a* Catch basic body
1*l* Linearly movable catch basic body
1*f* Guide cam

1*j* Screw-on piece
10 Displaceable catch body
10*m* Driver
10*h* Arresting lever
10*a* Stop end
10*e* Arresting engagement end
10*f* Release stop
10*k* Wedge surface
110 Bearing body
110*s* Pivot axis
110*b* Lock catch actuating body
2 Blocking element
2*k* Working piston
2*z* Hydraulic cylinder
2*w* Transition
2*s* Blocking lever
2*l* Actuating device
2*m* Memory device
20 Piston-cylinder device with working piston 2*k*
200 Actuating device
220 Hydraulic pump
230 Electromechanical rotary motor
235 Gearing
236 Guide cam
240 Electromechanical motor
21 First spring-loaded lever
22 Second spring-loaded lever
3*f* Restoring spring
3*k* Compensating piston
3*z* Compensating cylinder
30 Hydraulic spring store device
33 Restoring spring outside the hydraulic circuit
4 Check valve
4*r* Spring
4*k* Ball
5 Shut-off valve
5*s* Magnet coil
5*a* Magnet armature
5*v* valve plunger
5*dh* Rear through hole
5*dv* Front through hole
5*r* Restoring spring
5*u* Switch recess
58 Electrical power source
57 Switch
6 Door opener housing
6*a* Guide bevel for lock catch
11 Intermediate stop
12 Holding device
12*a* Triggering element
16 Hydraulic line of the hydraulic circuit
16*v* Branch
19 Lock catch actuating device
90 Lock catch

The invention claimed is:

1. A remote-actuable door opener for installation in a door having a preferably positionally fixed door frame and having a door leaf movably mounted thereon, having a movable door opener catch and having an actuating device including a remote-actuable blocking device which interacts directly or indirectly with the door opener catch in such a way that the door opener catch can be switched into a blocking position and into a release position, with it being possible for the door opener to be mounted on the door frame or on the door leaf, and with the door leaf or the door frame respectively having a lock catch, wherein the actuating device automatically sets the door opener catch into a position in which the door opener catch abuts against the lock catch in a closed position of the door, wherein at least one of the door opener catch or a catch body, which is movable on a bearing body, of the door opener catch interacts with a drive output element of at least one of the actuating device or a blocking unit via a ratchet mechanism which can be controlled by means of at least one of an electromechanical motor unit or an electric lifting magnet unit.

2. A remote-actuable door opener for installation in a door having a preferably positionally fixed door frame and having a door leaf movably mounted thereon, having a movable door opener catch and having an actuating device including a remote-actuable blocking device which interacts directly or indirectly with the door opener catch in such a way that the door opener catch can be switched into a blocking position and into a release position, with it being possible for the door opener to be mounted on the door frame or on the door leaf, and with the door leaf or the door frame respectively having a lock catch, wherein the actuating device automatically sets the door opener catch into a position in which the door opener catch abuts against the lock catch in a closed position of the door, wherein the door opener catch has a bearing body and a catch body which is movably guided on the bearing body during at least one of closing of the door or during opening of the door.

3. The door opener as claimed in claim 2, wherein the door opener catch is at least one of designed or mounted such that the door opener catch can move through a maximum actuating travel of X mm, with X being a value from 2 to 15.

4. The door opener as claimed in claim 3, wherein X is a value from 5 to 10.

5. The door opener as claimed in claim 2, wherein the actuating device is designed so as to load the door opener catch in a direction of actuating movement, specifically only in a region of the closed position of the door or only in a region which extends from an open position of the door with a door opening gap of Y mm to the closed position of the door, with Y being less than or equal to 15.

6. The door opener as claimed in claim 5, wherein Y is less than or equal to 10.

7. The door opener as claimed in claim 5, wherein Y is less than or equal to 5.

8. The door opener as claimed in claim 2, wherein the actuating device is designed as at least one of a force store device which can be coercively loaded during at least one of the opening of the door or during the closing of the door, or a motor device which can be operated using external energy.

9. The door opener as claimed in claim 8, wherein the motor device which can be operated using external energy has an electric motor unit as an electromechanical motor or electrohydraulic motor.

10. The door opener as claimed in claim 2, wherein the blocking device has, at a drive output side, a blocking element which can be automatically made to follow up the door opener catch in a closing direction and which can preferably be fixed in a followed-up position by means of the blocking device.

11. The door opener as claimed in claim 10, wherein the actuating device and the blocking element are formed as a common device.

12. The door opener as claimed in claim 10, wherein the blocking element is designed as a drive output element.

13. The door opener as claimed in claim 10, wherein at least one of the door opener catch or the blocking element is designed for continuously variable or stepped positioning of the door opener catch and of the blocking element respectively.

14. The door opener as claimed in claim 10, further comprising a memory device which registers at least one of the position of the door opener catch or the position of the blocking element.

15. The door opener as claimed in claim 2, wherein the catch body is guided in a linearly displaceable manner on the bearing body.

16. The door opener as claimed in claim 2, wherein the catch body is designed as a substantially female component and in that the bearing body is designed as a substantially male component.

17. The door opener as claimed in claim 2, wherein the bearing body is mounted in an immovable or movable manner in a door opener housing.

18. The door opener as claimed in claim 17, wherein the bearing body is pivotably mounted in the door opener housing.

19. The door opener as claimed in claim 2, wherein an arresting device is provided which acts between the bearing body and the catch body and which can be deactivated during actuating movement by interaction with the lock catch.

20. The door opener as claimed in claim 19, wherein the arresting device has a two-armed spring-loaded switching lever which is pivotably mounted on the catch body and which has, at a first end, a stop for the lock catch, and at a second end, an arresting end for detachable engagement with the bearing body.

21. The door opener as claimed in claim 20, wherein the arresting end of the switching lever and the bearing body have a detent toothing for detachable engagement with one another.

22. The door opener as claimed in claim 2, wherein the catch body has a rigidly connected driver which has a run-on side for interaction with a bevel of the lock catch and a driver side for contact against the lock catch during actuating movement.

23. The door opener as claimed in claim 22, wherein the bearing body is arranged in an immovable manner in a door opener housing, and a lock catch actuating body is arranged in the door opener housing in such a way that, during the closing of the door, the lock catch can be caused to retract by interaction with the lock catch actuating body, and the driver is arranged on the catch body in such a way that the lock catch, when deployed again after having been retracted, comes into contact with the driver.

24. The door opener as claimed in claim 2, wherein the door opener catch has a drive-input-side section on which a drive output element of the actuating device engages in such a way that the catch body is driven in a direction of actuating movement.

25. The door opener as claimed in claim 24, wherein the drive-input-side section of the door opener catch has a wedge surface and the drive output element has a wedge surface which interacts therewith.

26. The door opener as claimed in claim 24, wherein the drive output element is designed as a linear thrust element.

27. The door opener as claimed in claim 24, wherein the drive output element is acted on by a hydraulic or pneumatic system with a hydraulic circuit.

28. The door opener as claimed in claim 27, wherein the hydraulic system has an electrohydraulic pump for generating the hydraulic pressure.

29. The door opener as claimed in claim 24, wherein the drive output element is acted on directly or indirectly by a drive output of an electromechanical motor.

30. The door opener as claimed in claim 29, wherein the electromechanical motor is a rotary motor.

31. The door opener as claimed in claim 24, wherein the catch body has the drive-input-side section.

32. A method for operating a remote-actuable door opener for installation in a door having a preferably positionally fixed door frame and having a door leaf movably mounted thereon, having a movable door opener catch and having a remote-actuable blocking device which interacts directly or indirectly with the door opener catch in such a way that the door opener catch can be switched into a blocking position and into a release position, with it being possible for the door opener to be mounted on the door frame or on the door leaf, and with the door leaf or the door frame respectively having a lock catch, the method comprising:

during operation of the door opener, the door opener catch is automatically set into a position in which the door opener catch abuts against the lock catch in a closed position of the door, wherein the door opener catch has a bearing body and a catch body which is movably guided on the bearing body during at least one of closing of the door or during opening of the door.

33. The method as claimed in claim 32, wherein the automatic positioning of the door opener catch takes place during at least one of the closing of the door, after the closing of the door in the closed position of the door.

34. The method as claimed in claim 32, wherein the automatic positioning of the door opener catch takes place during or after each at least one of opening or closing actuation of the door.

* * * * *